US006208957B1

(12) United States Patent
Nomura

(10) Patent No.: US 6,208,957 B1
(45) Date of Patent: Mar. 27, 2001

(54) VOICE CODING AND DECODING SYSTEM

(75) Inventor: Toshiyuki Nomura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/111,790

(22) Filed: Jul. 8, 1998

(30) Foreign Application Priority Data

Jul. 11, 1997 (JP) ..... 9-202475

(51) Int. Cl.[7] ..... G10L 11/00; G10L 19/00

(52) U.S. Cl. ..... 704/207; 704/219; 704/220; 704/222

(58) Field of Search ..... 704/219, 220, 704/222, 207

(56) References Cited

U.S. PATENT DOCUMENTS

| | | | | |
|---|---|---|---|---|
| 5,708,757 | * | 1/1998 | Massaloux | 704/220 |
| 5,765,127 | * | 6/1998 | Nishiguchi et al. | 704/208 |
| 5,778,334 | * | 6/1998 | Ozawa et al. | 704/219 |
| 5,878,388 | * | 3/1999 | Nishiguchi et al. | 704/214 |
| 5,899,968 | * | 5/1999 | Navarro et al. | 704/220 |
| 5,960,388 | * | 9/1999 | Nishiguchi et al. | 704/208 |
| 5,963,898 | * | 10/1999 | Navarro et al. | 704/220 |

FOREIGN PATENT DOCUMENTS

| | | |
|---|---|---|
| 0 492 459 | 7/1992 | (EP) . |
| 0 696 026 | 2/1996 | (EP) . |
| 0 718 822 | 6/1996 | (EP) . |
| 4-171500 | 6/1992 | (JP) . |
| 8-263096 | 10/1996 | (JP) . |
| 9-160596 | 6/1997 | (JP) . |
| 95/10760 | 4/1995 | (WO) . |

OTHER PUBLICATIONS

P.P. Vaidyanathan, "Fundamentals of Mulitrate Systems", *Multirate Systems and Filter Banks*, Chapter 4.1.1, pp. 100–119.

Adoul et al., "Fast CELP coding based on algebraic codes", Proc. ICASSP, IEEE, 1987, pp. 1957–1960.

Furui, "Digital Voice Processing", Tokai University Shuppan Kai, Chapter 5, 1985.

N. Sugamura et al. "Speech Data Compression by LSP Speech Analysis–Synthesis Technique", Paper of Insti. of Elec. and Comm. Engineers of Japan, J64–A 1981, pp. 599–606.

Nomura et al., "A Bitrate and Bandwidth Scalable Celp Coder", IEEE Int'l Conf. On Acoustics, Speech & Signal Processing, Seattle, WA May 12–15, 1998, pp.341–343, XP002112625.

* cited by examiner

*Primary Examiner*—David R. Hudspeth
*Assistant Examiner*—Susan Wieland
(74) *Attorney, Agent, or Firm*—Foley & Lardner

(57) ABSTRACT

A first CELP coding circuit receiving a signal obtained by down-sampling of an input signal by a down-sampling circuit, outputs a part of coded output to a second CELP coding circuit. The second CELP coding circuit encodes the input signal on the basis of the coded output of the first CELP coding circuit. A multiplexer outputs the coded outputs of the first and second CELP coding circuits in a form of a bit stream. A demultiplexer outputs the coded output of the first CELP coding circuit from the bit stream to a first CELP decoding circuit when a control signal is low bit rate, and extracts a part of the output of the first CELP coding circuit and the output of the second CELP coding circuit to output to a second CELP decoding circuit to output via a switch circuit when the control signal is high bit rate.

24 Claims, 15 Drawing Sheets

FIG.15

| PULSE NUMBER | PULSE POSITION CANDIDATE |
|---|---|
| 0 | 0, 5, 10, 15, 20, 25, 30, 35 |
| 1 | 1, 6, 11, 16, 21, 26, 31, 36 |
| 2 | 2, 7, 12, 17, 22, 27, 32, 37 |
| 3 | 3, 8, 13, 18, 23, 28, 33, 38 |
| 4 | 4, 9, 14, 19, 24, 29, 34, 39 |

FIG.16

| PULSE NUMBER | PULSE POSITION CANDIDATE |
|---|---|
| 0 | 1, 11, 21, 31, 41, 51, 61, 71 |
| 1 | 3, 13, 23, 33, 43, 53, 63, 73 |
| 2 | 5, 15, 25, 35, 45, 55, 65, 75 |
| 3 | 7, 17, 27, 37, 47, 57, 67, 77 |
| 4 | 9, 19, 29, 39, 49, 59, 69, 79 |

VOICE CODING AND DECODING SYSTEM

BACKGROUND OF THE INVENTION

1. Field of the Invention

The present invention relates to a voice coding system and a decoding system based on hierarchical coding.

2. Description of the Related Art

Conventionally, a voice coding and decoding system based on hierarchical coding, in which a sampling frequency of a reproduction signal is variable depending upon a bit rate to be decoded, has been employed intending to make it possible to decode a voice signal with relatively high quality while band width is narrow, even when a part of packet drops out upon transmitting the voice signal on a packet communication network. For example, in Japanese Unexamined Patent Publication No. Heisei 8-263096 (hereinafter referred to as "publication 1"), there has been proposed a coding method and a decoding method for effecting hierarchical coding of an acoustic signal by band division. In this coding method, upon realization of hierarchical coding with N hierarchies, a signal consisted of a low band component of an input signal is coded in a first hierarchy, a differential signal derived by subtracting n−1 in number of signals coded and decoded up to the (n−1)th hierarchy from a signal consisted of a component of the input signal having wider band than the (n−1)th hierarchy, in the (n)th hierarchy (n=2, . . . , N−1) is coded. In the (N)th hierarchy, a differential signal derived by subtracting N−1 in number of signals coded and decoded up to the (N−1)th hierarchy from the input signal, is coded.

Referring to FIG. 12, operation of the voice coding and decoding system employing a Code Excited Linear Predictive (CELP) coding method in coding each hierarchy, will be discussed. For simplification of disclosure, the discussion will be given for the case where number of hierarchies is two. Similar discussion will be given with respect to three or more hierarchies. In FIG. 12, there is illustrated a construction, in which a bit stream coded by a voice coding system can be decoded by two kinds of bit rates (hereinafter referred to as high bit rate and low bit rate) in a voice decoding system. It should be noted that FIG. 12 has been prepared by the inventors as a technology relevant to the present invention on the basis of the foregoing publication and publications identified later.

Referring to FIG. 12, discussion will be given with respect to the voice coding system. A down-sampling circuit 1 down-samples (e.g. converts a sampling frequency from 16 kHz to 8 kHz) an input signal to generate a first input signal and output to a first CELP coding circuit 2. Here, the operation of the down-sampling circuit 1 has been discussed in P. P. Vaidyanathan, "Multirate Systems and Filter Banks", Chapter 4.1.1 (FIG. 4.1–7) (hereinafter referred to as publication 2). Since reference can be made to the disclosure of the publication 2, discussion will be neglected.

The first CELP coding circuit 2 performs a linear predictive analysis of the first input signal per every predetermined frames to derive a linear predictive coefficient expressing spectrum envelop characteristics of a voice signal and encodes an excitation signal of a corresponding linear predictive synthesizing filter and the derived linear predictive coefficient, respectively. Here, the excitation signal is consisted of a frequency component indicative of a pitch frequency, a remaining residual component and gains thereof. The frequency component indicative of the pitch frequency is expressed by an adaptive code vector stored in a code book storing past excitation signals, called as an adaptive code book. The foregoing residual component is expressed as a multipulse signal disclosed in J-P. Adoul et al. "Fast CELP Coding Based on Algebraic Codes" (Proc. ICASSP, pp. 1957–1960, 1987) (hereinafter referred to as "publication 3").

By weighted summing of the foregoing adaptive code vector and the multipulse signal with a gain stored in the gain code book, the excitation signal is generated.

A reproduced signal can be synthesized by driving the foregoing linear predictive synthesizing filter by the foregoing excitation signal. Here, selection of the adaptive code vector, the multipulse signal and the gain is performed to make an error power minimum with audibility weighting of an error signal between the reproduced signal and the first input signal. Then, an index corresponding to the adaptive code vector, the multipulse signal, the gain and the linear predictive coefficient is output to a first CELP decoding circuit 3 and a multiplexer 7.

In the first CELP decoding circuit 3, with taking the index corresponding to the adaptive code vector, the multipulse signal, the gain and the linear predictive coefficient as input, decoding is performed, respectively. By weighted summing of the adaptive code vector and the multipulse signal weighted by the gain, the excitation signal is derived. By driving the linear predictive synthesizing filter by the excitation signal, the reproduced signal is generated. Also, the reproduced signal is output by an up-sampling circuit 4.

The up-sampling circuit 4 generates a signal by up-sampling (e.g. converted the sampling frequency from 8 kHz to 16 kHz) the reproduced signal to output to a differential circuit 5. Here, with respect to the up-sampling circuit 4, since reference can be made to Chapter 4.1.1 (FIG. 4.1–8), discussion will be neglected.

The differential circuit 5 generates a differential signal of the input signal and the up-sampled reproduction signal and outputs it to a second CELP coding circuit 6.

The second CELP coding circuit 6 effects coding of the input differential signal similarly to the first CELP coding circuit 2. The index corresponding to the adaptive code vector, the multipulse signal, the gain and the linear predictive coefficient is output to the multiplexer 7. The multiplexer 7 outputs the four kinds of indexes input from the first CELP coding circuit 2 and the four kinds of indexes input from the second CELP coding circuit 6 with converting into the bit stream.

Next, discussion will be given hereinafter with respect to the voice decoding system. The voice decoding system switches operation by a demultiplexer 8 and a switch circuit 13 depending a control signal identifying two kinds of bit rates capable of decoding operation.

The demultiplexer 8 inputs the bit stream and the control signal. When the control signal indicates the high bit rate, the four kinds of indexes coded in the first CELP coding circuit 2 and the four kinds of indexes coded by the second CELP coding circuit 6 are extracted to output to a first CELP decoding circuit 9 and a second CELP decoding circuit 10, respectively. On the other hand, when the control signal indicates low bit rate, the four kinds of indexes coded in the first CELP coding circuit 2 is extracted to output only to the first CELP decoding circuit 9.

The first CELP decoding circuit 9 decodes respective of the adaptive code vector, the multipulse signal, the gain and the linear predictive coefficient from the four kinds of indexes input, by the same operation as the first decoding circuit 3 to generate the first reproduced signal to output to the switch circuit 13.

In the up-sampling circuit 11, the first reproduced signal input via the switch circuit 13 up-samples similarly to the up-sampling circuit 4 to output the up-sampled first reproduced signal to the adder circuit 12.

The second CELP decoding circuit 10 decodes respective of the adaptive code vector, the multipulse signal, the gain and the linear predictive coefficient from the input four kinds of indexes to generate the reproduced signal to output to the adder circuit 12.

The adder circuit 12 adds the input reproduced signal and the first reproduced signal up-sampled by the up-sampling circuit 11 to output to the switch circuit 13 as a second reproduced signal.

The switch circuit 13 inputs the first reproduced signal, the second reproduced signal and the control signal. When the control signal indicates high bit rate, the input first reproduced signal is output to the up-sampling circuit 11 to output the input second reproduced signal as the reproduced signal of the voice coding system. On the other hand, when the control signal indicates low bit rate, the input first reproduced signal is output as the reproduced signal of the voice coding system.

Next, referring to FIG. 13, discussion will be given with respect to the coding circuit on the basis of the CELP coding method used in the first CELP coding circuit 2 and the second CELP coding circuit 6, shown in FIG. 12.

Referring to FIG. 13, a frame dividing circuit 101 divides the input signal input via an input terminal 100 per every frame to output to a sub-frame dividing circuit 102. The sub-frame dividing circuit 102 further divides the input signal in the frame per every sub-frame to output to a linear predictive analyzing circuit 103 and a target signal generating circuit 105. The linear predictive analyzing circuit 103 performs linear predictive analysis of the signal input via the sub-frame dividing circuit 103 per sub-frame to output linear predictive coefficient a(i), i=1, . . . , Np, to a linear predictive coefficient quantizing circuit 104, a target signal, generating circuit 105, an adaptive code book retrieving circuit 107 and a multipulse retrieving circuit 108. Here, Np is order of linear predictive analysis, e.g. "10". As linear predictive analyzing method, autocorrelation method, covariance method and so forth. Detail has been discussed in Furui, "Digital Voice Processing" (Tokai University Shuppan Kai), Chapter 5 (hereinafter referred to as "publication 4").

In the linear predictive coefficient quantization circuit 104, the linear predictive coefficients obtained per sub-frame are aggregatingly quantized per the frame. In order to reduce the bit rate, quantization is performed at the final sub-frame in the frame. For obtaining the quantized value of other sub-frame, a method to use an interpolated value of the quantized values of the relevant frame and the immediately preceding frame is frequently used. The quantization and interpolation are performed after conversion of the linear predictive coefficient into linear spectrum pair (LSP). Here, conversion from the linear predictive coefficient into LSP has been disclosed in Sugamura, et al. "Voice Information Compression by Linear Spectrum Pair (LSP) Voice Analysis Synthesizing Method" (Paper of Institute of Electronics and Communication Engineers of Japan, J64-A, pp. 599–606, 1981 (hereinafter referred to as "publication 5")). As the quantization method of LSP, a known method can be used. A particular method has been disclosed in Japanese Unexamined Patent Publication No. Heisei 4-171500 (Patent Application No. 2-297600) (hereinafter referred to as "publication 6"), for example. The disclosure of the publication 6 is herein incorporated by reference.

Also, the linear predictive coefficient quantization circuit 104 converts the quantized LSP into quantized linear predictive coefficients a' (i), i=I, . . . , Np and then output the quantized linear predictive coefficient to the target signal generating circuit 105, the adaptive code book retrieving circuit 107 and the multipulse retrieving circuit 108 to output to an output the index indicative of the quantized linear predictive coefficient to an output terminal 113.

The target signal generating circuit 105 generates an audibility weighted signal by driving an audibility weighted filter Hw(z) as expressed by the following equation (1) with the input signal:

$$Hw(z) = \frac{1 - \sum_{i=1}^{Np} a(i) \cdot R2^i \cdot z^{-i}}{1 - \sum_{i=1}^{Np} a(i) \cdot R1^i \cdot z^{-i}} \tag{1}$$

wherein R1 and R2 are weighting coefficients controlling audibility weighting amount and, for example R1=0.6 and R2=0.9

Next, the linear predictive synthesizing filter (see next equation (2)) of the immediately preceding sub-frame held in the of the same circuit and an audibility weighted synthesizing filter Hsw(z) continuously connecting the audibility weighted filters Hw(z) are driven by the excitation signal of the immediately preceding sub-frame. Subsequently, a filter coefficient of the audibility weighted synthesizing filter is modified by a current sub-frame to drive the same filter by a zero input signal having all signal values being zero to derive a zero input response signal.

$$Hs(z) = \frac{1}{1 - \sum_{i=1}^{Np} a'(i) \cdot z^{-1}} \tag{2}$$

Furthermore, by subtracting the zero input response signal from the audibility weighted signal, the target signals X(n), n=0, . . . , N−1 are generated. Here, N is a sub-frame length. On the other hand, the target signal X(n) is output to the adaptive code book retrieving circuit 107, the multipulse retrieving circuit 108 and the gain retrieving circuit 109.

In the adaptive code book retrieving circuit 107, by the excitation signal of the immediately preceding sub-frame obtained via a sub-frame buffer 106, the adaptive code book storing past excitation signals is updated. The adaptive code vector signals Adx(n), n=0, . . . , N−1, corresponding to a pitch dx are signals sampled N samples going back for dx samples from the sample immediately preceding sub-frame of the current sub-frame. Here, when the pitch dx is shorter than the sub-frame length N, the sampled dx samples repeatedly connected up to the sub-frame length to generate the adaptive code vector signal.

Using the generated adaptive code vector signal Adx(n), n=0, . . . , N−1, the audibility weighted synthesizing filter initialized per sub-frame (hereinafter referred to as audibility weighted synthesizing filter Zsw(z) in zero state) is driven to generate a reproduced signal SAdx(n), n=0, . . . , N−1. Then, a pitch d making an error E1(dx) of the target signal X(n) and the reproduced signal SAdx(n) as expressed by the following equation(3) is selected from a predetermined retrieving range (e.g. dx=17, . . . , 144). The adaptive code vector signal of the pitch d and the reproduced signal are set to be Ad(n) and SAd(n), respectively.

$$E1(dx) = \sum_{n=0}^{N-1} X(n)^2 - \frac{\left(\sum_{n=0}^{N-1} X(n) \cdot SAdx(n)\right)^2}{\sum_{n=0}^{N-1} X(n) \cdot SAdx(n)^2} \quad (3)$$

On the other hand, the adaptive code book retrieving circuit 107 outputs the index of the selected pitch d to an output terminal 110 and the selected adaptive code vector signal Ad(n) to the gain retrieving circuit 109, and the reproduced signal SAd(n) thereof to the gain retrieving circuit 109 and the multipulse retrieving circuit 108.

In the pulse retrieving circuit 108, P in number of non-zero pulses consisting the multipulse signal are retrieved. Here, positions of respective pulses are not limited to pulse position candidates. However, all of the pulse position candidates become mutually different values. For example, when sub-frame length N=40 and pulse number P=5, the example of the pulse position candidate is shown in FIG. 15.

On the other hand, an amplitude of the pulse is only polarity. Accordingly, coding of the multipulse signal may be performed with assuming total number of combinations of the pulse position candidates and polarities being J, by establishing the multipulse signal of Cjx(n), n=0, . . . , N−1, with respect to the index jx indicative of the combinations, driving the audibility weighted synthesizing filter Zsw(z) in zero state by the multipulse signal, generating reproduced signals SCjx(n), n=0, . . . , N−1, and selecting the index j so that the error E2(jx) expressed by the following equation (4) to be minimum. This method has been disclosed in the foregoing publication 3 and Japanese Unexamined Patent Publication No. Heisei 9-160596 (Patent Application No. 7-318071) (hereinafter referred to as "publication 7"). The disclosure is herein incorporated by reference. The multipulse signal corresponding to the selected index j and the reproduced signal thereof are assumed to be Cj(n) and SCj(n).

$$E2(jx) = \sum_{n=0}^{N-1} X'(n)^2 - \frac{\left(\sum_{n=0}^{N-1} X(n) \cdot SAjx(n)\right)^2}{\sum_{n=0}^{N-1} SAjx(n)^2} \quad (4)$$

where X' (n), n=0, . . . , N−1 are signals derived by orthogonalizing the target signal X(n) with respect to the reproduced signal SAd(n) of the adaptive code vector signal as expressed by the following equation (5).

$$X'(n) = X(n) - \frac{\sum_{n=0}^{N-1} X(n) \cdot SAd(n)}{\sum_{n=0}^{N-1} SAd(n)^2} - SAd(n) \quad (5)$$

On the other hand, the multipulse retrieving circuit 108 outputs the selected multipulse signal Cj(n) and the reproduced signal SCj(n) thereof to the gain retrieving circuit 109 and corresponding index to the output terminal 111.

In the gain retrieving circuit 109, the gains of the adaptive code vector signal and the multipulse signal are two-dimensional vector quantized. The gains of the adaptive code vector signal and the multipulse signal accumulated in the gain code book of the code book size K are respective assumed to be Gkx(0), Gkx(1), kx=0, . . . , K−1. The index k of the optimal gain is selected to make the error E3(kx) as expressed by the following equation (6) to be minimum using the reproduced signal SAd(n) of the adaptive code vector, the reproduced signal SCj (n) of the multipulse and the target signal X(n). The gains of the adaptive code vector signal and the multipulse signal of the selected index k are respectively assumed to be Gk(0) and Gk(1).

$$E3(kx) = \sum_{n=0}^{N-1} (X(n) - Gkx(0) \cdot SAd(n) - Gkx(1) \cdot SCj(n))^2 \quad (6)$$

On the other hand, the excitation signal is generated using the selected gain, the adaptive code vector and the multipulse signal and output to a sub-frame buffer 106. Also, the index corresponding to the gain is output to the output terminal 112.

Next, referring to FIG. 14, a construction of the decoding circuit based on the CELP coding system, employed in the first CELP decoding circuit 3 on the coding side and also employed in the first CELP decoding circuit 9 and the second CELP decoding circuit on the decoding side, will be discussed.

In the linear predictive coefficient decoding circuit 118, the quantized linear predictive coefficients a' (i), i=1, . . . , Np decoded from the input index via the input terminal 114 to output to the reproduced signal generating circuit 122.

In the adaptive code book decoding circuit 119, the adaptive code vector signal Ad(n) decoded from the index of the foregoing pitch via the input terminal is output to the gain decoding circuit 121, and in the multipulse decoding circuit 120, the multipulse signal Cj(n) decoded from the index of the multipulse signal input via the input terminal 117 is also output to the gain decoding circuit 121.

In the gain decoding circuit 121, the gains Gk(0) and Gk(1) are decoded from the index of the gains input via the input terminal 115 to generate the excitation signal using the adaptive code vector signal, the multipulse signal and the gain to output to the reproduced signal generating circuit 122.

In the reproduced signal generating circuit 122, the reproduced signal is generated by driving the linear predictive synthesizing filter Hs(z) by the excitation signal to output to an output terminal 123.

However, the voice coding and decoding system discussed with reference to FIGS. 12 to 14 encounters a problem in insufficiency of coding efficiency in hierarchical CELP coding of the voice signal in second and subsequent hierarchies.

The reason is that, in the (n)th hierarchy (n=2, . . . , N), the differential signal derived by subtracting n−1 in number of reproduced signal CELP coded and decoded up to the (n−1)th hierarchy from the input signal, is CELP coded.

Namely, in the (n)th hierarchy, respective coding parameters (linear predictive coefficient, pitch, multipulse signal and gain) upon CELP coding of the differential signal are different from the quantization error value of the corresponding parameter up to the (n−1)th hierarchy. Therefore, information expressed by the coder of each parameter of (n−1)th hierarchy and information expressed by the coder of the (n)th hierarchy overlap not to improve coding efficiency of respective coding parameter and thus not to improve quality of the reproduced signal.

SUMMARY OF THE INVENTION

Accordingly, the present invention has been worked out in view of the shortcoming set forth above. Therefore, it is an object of the present invention to provide a voice coding system and a voice decoding system, which can achieve high efficiency in a voice coding and decoding system on the basis of a hierarchical coding, in which a sampling frequency of a reproduced signal is variable depending upon a bit rate for decoding.

According to the first aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N).

According to the second aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal in the decoding means of (n)th hierarchy (n=2, . . . , N).

According to the third aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals; and a gain retrieving circuit coding gains of the adaptive code vector signal, the first multipulse signal, the second multipulse signal.

According to the fourth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n−1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal in the decoding means of (n)th hierarchy (n=2, . . . , N);

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal; and a gain decoding circuit decoding the gain from the index indicative of the gain of the (n)th hierarchy and generating an excitation signal from the adaptive code vector signal, the first multipulse signal, the second multipulse signal and the decoded gain.

According to the fifth aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprising:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N) and having n-stage audibility weighted filters;

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals; and a gain retrieving circuit coding gains of the adaptive code vector signal, the first multipulse signal, the second multipulse signal;

a linear predictive coefficient converting circuit converting linear predictive coefficients coded and decoded up to the (n−1)th hierarchy into a coefficient on a sampling frequency of the input signal in the (n)th hierarchy;

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters.

According to the sixth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal;

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal;

a gain decoding circuit decoding the gain from the index indicative of the gain of the (n)th hierarchy and generating an excitation signal from the adaptive code vector signal, the first multipulse signal, the second multipulse signal and the decoded gain;

a linear predictive coefficient converting circuit converting linear predictive coefficients derived up to the (n−1)th hierarchy into a coefficient on the sampling frequency of the input signal in the (n)th hierarchy; and a reproduced signal generating circuit for generating a reproduced signal by driving n-stage linear predictive synthesizing filters by the excitation signal.

According to the seventh aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

a linear predictive coefficient converting circuit converting linear predictive coefficients coded and decoded up to the (n−1)th hierarchy into a coefficient on a sampling frequency of the input signal in the (n)th hierarchy, in codingmeans of the (n)th hierarchy (n=2, . . . , N);

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters;

an adaptive code book retrieving circuit having n-stage audibility weighted reproduction filters;

a multipulse generating circuit;

a multipulse retrieving circuit; and a target signal generating circuit having n-stage audibility weighted filters.

According to an eighth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream;

a linear predictive coefficient converting circuit converting linear predictive coefficients derived up to the (n−1)th hierarchy into a coefficient on a sampling frequency of the input signal in the (n)th hierarchy; and a reproduced signal generating circuit generating a reproduced signal by driving n-stage linear predictive synthesizing filters by the excitation signal.

According to the ninth aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

a multipulse generating circuit generating a first multipulse signal from n−1 multipulse signals coded and decoded up to the (n−1)th hierarchy in the (n)th hierarchy (n=2, . . . , N) of coding means; and a multipulse retrieving circuit coding a pulse position of a second multipulse signal in the (n)th hierarchy among pulse position candidates excluding positions of pulses forming the first multipulse signal.

According to the tenth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream;

a multipulse generating circuit generating a first multipulse signal from the index indicative of up to the n−1 multipulse signals; and a multipulse decoding circuit decoding a second multipulse signal from the index indicative of the (n)th hierarchy of multipulse signal on the basis of pulse position candidates excluding the positions of the pulses forming the first multipulse signal.

According to the eleventh aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals;

a gain retrieving circuit coding gains of the adaptive code vector signal, the first multipulse signal, the second multipulse signal; and a linear predictive quantizing circuit coding a difference between linear predictive coefficient coded and decoded up to (n−1)th hierarchy and linear predictive coefficient newly obtained by analysis at the (n)th hierarchy.

According to the twelfth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch of (n)th hierarchy and generating an adaptive code vector signal;

a multipulse generating circuit generating a first multipulse signal from the index indicative of multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal;

a gain decoding circuit decoding the gain from the index indicative of the gain of the (n)th hierarchy and generating an excitation signal from the adaptive code vector signal, the first multipulse signal, the second multipulse signal and the decoded gain; and a linear predictive coefficient decoding circuit decoding a linear predictive coefficient from an index indicative of linear predictive coefficients up to the (n)th hierarchy.

According to the thirteenth aspect of the present invention, a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies, comprises:

a linear predictive quantization circuit for coding a difference between linear predictive coefficient coded and decoded up to (n−1)th hierarchy and a linear predictive coefficient newly obtained by analysis in coding of the (n)th hierarchy, in the (n)th hierarchy (n=2, . . . , N).

According to the fourteenth aspect of the present invention, a voice decoding system hierarchically varying sampling frequencies of a reproduced signal depending upon bit rates to be decoded, comprises:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and a linear predictive coefficient decoding circuit decoding linear predictive coefficient from index indicative of linear predictive coefficient up to the (n)th hierarchy.

According to the fifteenth aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by varying sampling frequencies in sequential order to the signal obtained by lower sampling frequency, per every N hierarchies for generating a bit stream, the voice coding system including coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N); and a voice decoding system hierarchically varying sampling frequencies of a reproduced signal depending upon bit rates to be decoded, including decoding means, each corresponding to each of N kinds of decodable bit rates, demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system, and an adaptive code book decoding circuit decoding a pitch from an index indicative of the pitch up to (n)th hierarchy and generating an adaptive code vector signal in the decoding means of (n)th hierarchy (n=2, . . . , N).

According to the sixteenth aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals; a gain retrieving circuit coding gains of the adaptive code vector signal, the first multipulse signal, the second multipulse signal; and a voice decoding system hierarchically varying sampling frequencies of a reproduced signal depending upon bit rates to be decoded, including decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream output by the voice coding system;

an adaptive code book decoding circuit decoding a pitch from an index indicative of the pitch up to (n)th hierarchy and generating an adaptive code vector signal in the decoding means of (n)th hierarchy (n=2, . . . , N);

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal; and a gain decoding circuit decoding the gain from the index indicative of the gain of the (n)th hierarchy and generating an excitation signal from the adaptive code vector signal, the first multipulse signal, the second multipulse signal and the decoded gain.

According to the seventeenth aspect of the present invention, a voice coding and decoding system comprising:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal for generating a bit stream and the signals obtained by the varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N) and having n-stage audibility weighted filters;

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals; and a gain retrieving circuit coding gains of the adaptive code vector signal, the first multipulse signal, the second multipulse signal;

a linear predictive coefficient converting circuit converting linear predictive coefficients coded and decoded up to the (n−1) ath hi erarchy into a coefficient on a sampling frequency of the input signal in the (n)th hierarchy;

a linear predictive residual difference signal generating circuit deriving a linear predictive residual difference signal of the in put signal from the converted n−1 linear predictive coefficients;

a linear pre dictive analyzing circuit deriving a linear pr edictive coefficient by linear predictive analysis of derived linear predictive residual difference signal;

a linear predictive coefficient quantizing circuit quantizing newly derived linear predictive coefficient; and a target signal generating circuit having n-stage audibility weighted filters; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal;

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal;

a gain decoding circuit decoding the gain from the index indicative of the gain of the (n)th hierarchy and generating an excitation signal from the adaptive code vector signal, the first multipulse signal, the second multipulse signal and the decoded gain;

a linear predictive coefficient converting circuit converting linear predictive coefficients derived up to the (n−1)th hierarchy into a coefficient on the sampling frequency of the input signal in the (n)th hierarchy; and a reproduced signal generating circuit for generating a reproduced signal by driving n-stage linear predictive synthesizing filters by the excitation signal.

According to an eighteenth aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies for generating a bit stream, including:

a linear predictive coefficient converting circuit converting linear predictive coefficients coded and decoded up to the (n−1)th hierarchy into a coefficient on a sampling frequency of the input signal in the (n)th hierarchy, in coding means of the (n)th hierarchy (n=2, . . . , N);

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and an adaptive code book retrieving circuit having n-stage audibility weighted reproduction filter;

a multipulse generating circuit;

a multipulse retrieving circuit; and a target signal generating circuit having n-stage audibility weighted filters; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system;

a linear predictive coefficient converting circuit converting linear predictive coefficients derived up to the (n−1)th hierarchy into a coefficient on a sampling frequency of the input signal in the (n)th hierarchy; and a reproduced signal generating circuit generating a reproduced signal by driving n-stage linear predictive synthesizing filters by the excitation signal.

According to the nineteenth aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies for generating a bit stream, including:

a multipulse generating circuit generating a first multipulse signal from n−1 multipulse signals coded and decoded up to the (n−1)th hierarchy in the (n)th hierarchy (n=2, . . . , N) of coding means; and a multipulse retrieving circuit coding a pulse position of a second multipulse signal in the (n)th hierarchy among pulse position candidates excluding positions of pulses forming the first multipulse signal; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system;

a multipulse generating circuit generating a first multipulse signal from the index indicative of up to the n−1 multipulse signals; and a multipulse decoding circuit decoding a second multipulse signal from the index indicative of the (n)th hierarchy of multipulse signal on the basis of pulse position candidates excluding the positions of the pulses forming the first multipulse signal.

According to the twentieth aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming the first multipulse signals;

a gain retrieving circuit coding gains of the adaptive code vector signal, the first multipulse signal, the second multipulse signal; and a linear predictive quantizing circuit coding a difference between linear predictive coefficient coded and decoded up to (n−1)th hierarchy and linear predictive coefficient newly obtained by analysis at the (n)th hierarchy; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system; and an adaptive code book decoding circuit decoding a pitch from an index indicative of the pitch of (n)th hierarchy and generating an adaptive code vector signal;

a multipulse generating circuit generating a first multipulse signal from the index indicative of multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming the first multipulse signal;

a gain decoding circuit decoding the gain from the index indicative of the gain of the (n)th hierarchy and generating an excitation signal from the adaptive code vector signal, the first multipulse signal, the second multipulse signal and the decoded gain; and a linear predictive coefficient decoding circuit decoding a linear predictive coefficient from an index indicative of linear predictive coefficients up to the (n)th hierarchy.

According to the twenty-first aspect of the present invention, a voice coding and decoding system comprises:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by the varying sampling frequencies in sequential order to the signal obtained by lower sampling frequency, per every N hierarchies for generating a bit stream, including:

a linear predictive quantization circuit for coding a difference between linear predictive coefficient coded and decoded up to (n−1)th hierarchy and a linear predictive coefficient newly obtained by analysis in coding of the (n)th hierarchy, in the (n)th hierarchy (n=2, . . . , N); and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system; and a linear predictive coefficient decoding circuit decoding linear predictive coefficient from index indicative of linear predictive coefficient up to the (n)th hierarchy.

According to the twenty-second aspect of the present invention, a voice coding and decoding system comprises:

a down-sampling circuit down-sampling an input signal for outputting as a first input signal;

first coding means for coding the first input signal;

second coding means for coding the input signal on the basis of a coding output of the first coding means;

a multiplexer outputting the coded outputs of the first coding means and the second coding means in a form of a bit stream;

a demultiplexer inputting the bit stream and a control signal, when the control signal is indicative of a first bit rate, the coding output of the first coding means being output from the bit stream to a first decoding means, and when the control signal is indicative of a second bit rate, a part of the coded output of the first coding means and the coded output of the second coding means being extracted from the bit stream for outputting to a second decoding means, the first and second decoding means decoding a reproduced signal depending on the control signal for outputting via a switch.

In the practical construction, the second coding means comprises coding means of the second hierarchy in the voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from the input voice signal and the signals obtained by varying sampling frequencies in sequential order to the signal obtained by lower sampling frequency, per every N hierarchies for generating a bit stream, the voice coding system including coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N). Also, the second decoding means comprises decoding means of the second hierarchy (n=2) of a voice decoding system hierarchically varying sampling frequencies of a reproduced signal depending upon bit rates to be decoded, including decoding means, each corresponding to each of N kinds of decodable bit rates, demultiplexer selecting of decoding means of (n)th hierarchy among the decoding means depending upon a control signal indicative of a decoding bit rate and extracting an index indicative of pitches up to (n)th hierarchy and indexes of multipulse signal, gain and linear predictive coefficient of (n)th hierarchy, from the bit stream generated by the voice coding system, and an adaptive code book decoding circuit decoding a pitch from an index indicative of the pitch up to (n)th hierarchy and generating an adaptive code vector signal in the decoding means of (n)th hierarchy (n=2, . . . , N).

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings:

FIG. 15 is an illustration showing a correspondence between a pulse number and a pulse position candidate; and FIG. 16 is an illustration showing a correspondence between a pulse number and a pulse position candidate.

DESCRIPTION OF THE PREFERRED EMBODIMENT

Figure 1:
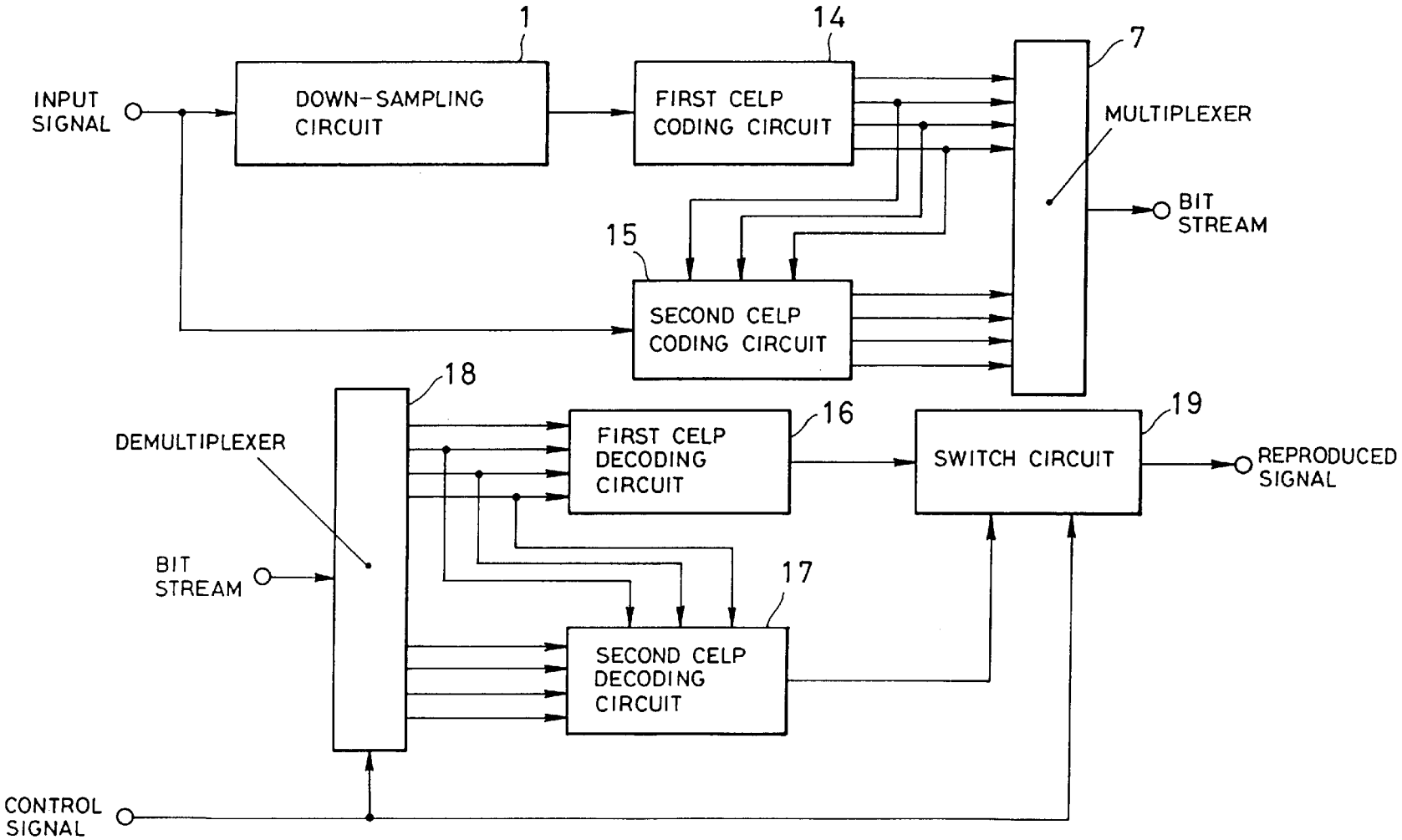
FIG. 1 is a block diagram showing a construction of the first embodiment of a voice coding and decoding system according to the present invention.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

The present invention is characterized by performing a multi-stage coding per coding parameter in a hierarchical CELP coding. More particularly, in the preferred embodiment, a voice coding system preparing in N−1 in number of signals with varying sampling frequencies of the input voice signals and multiplexing the input voice signals and the signals sampled with varying the sampling frequencies with aggregating indexes indicative of linear predictive coefficients obtained by coding, pitches, multiples signals and gains, for N hierarchies from the signal having the lowest sampling frequency, in sequential order, includes an adaptive code book retrieving circuit (identified by the reference numeral 127 in FIG. 2) generating corresponding an adaptive code vector signal by coding a differential pitch with respect to a pitch coded and decoded up to (n−1)th hierarchy, in coding of (n)th hierarchy (n=2, . . . , N) (as one example, second CELP coding circuit in FIG. 1), a multipulse generating circuit (identified by the reference numeral 128 in FIG. 2) generates a first multipulse signal from (n−1) in number of multipulse signals coded and decoded up to (n−1)th hierarchy, a multipulse retrieving circuit (identified by the reference numeral 129 in FIG. 2) coding a pulse position of the second multipulse signal at (n)th hierarchy among pulse position candidates excluding the position of the pulse consisting the first multipulse signal, a gain retrieving circuit (identified by the reference numeral 130 in FIG. 2) coding gains of the adaptive code vector signal, the first multipulse signal and the second multipulse signal, a linear predictive analyzing circuit (identified by the reference numeral 103 in FIG. 2) performing linear predictive analysis of the derived linear predictive error signal for deriving a linear predictive coefficient, a linear predictive coefficient quantization circuit (identified by the reference numeral 104 in FIG. 2) quantizing the newly derived linear predictive coefficient, and a target signal generating circuit having a n-stage audibility weighted filter.

On the other hand, in the preferred embodiment, a voice decoding system hierarchically varying sampling frequency of reproduced signal depending upon bit rate to be decoded, includes decoding means corresponding to decodable N kinds of bit rates, a demultiplexer (identified by the reference numeral 18 in FIG. 1) selecting decoding means of (n)th hierarchy (n=1, . . . N) among the decoding means and extracting an index indicative of a pitch up to (n)th hierarchy and a gain of the multipulse signal and an index indicative of the linear predictive coefficient of the (n)th hierarchy, and the decoding means of the (n)th hierarchy (n=2, . . . , N) includes an adaptive code book decoding circuit (identified by the reference numeral 134 in FIG. 3) decoding the pitch from the index indicative of the pitch up to the (n)th hierarchy and generating an adaptive code vector signal, a multipulse generating circuit (identified by the reference numeral 136 in FIG. 3) generating the first multipulse signal from an index indicative of the multipulse signal and the gain up to the (n)th hierarchy, a multipulse decoding circuit (identified by the reference numeral 135 in FIG. 3) decoding the second multipulse signal from the index indicative of the multipulse signal of the (n)th hierarchy in the basis of the pulse position candidate excluding the pulse position consisting the first multipulse signal, a gain decoding circuit (identified by the reference numeral 137 in FIG. 3) decoding the gain from the index indicative the gain of the (n)th hierarchy and generating an excitation signal from the adaptive code vector signal, the first multipulse signal, the second multipulse signal and the decoded gain, a linear predictive coefficient decoding circuit (identified by the reference numeral 118 in FIG. 3) decoding quantized linear predictive coefficient a'(i), i=1, . . . , Np, from the input index via the input terminal (identified by the reference numeral 114 in FIG. 3), and a reproduced signal generating circuit (identified by the reference numeral 122 in FIG. 3) generating the reproduced signal by driving the linear predictive synthesizing filter by the excitation signal to output to the output terminal (identified by the reference numeral 123 in FIG. 3).

The preferred embodiment of the voice coding and decoding system according to the present invention will be discussed in terms of the embodiment, in which the bit stream coded by the voice coding system is decoded at two kinds of bit rates (hereinafter referred to as high bit rate and low bit rate). A down-sampling circuit (identified by the reference numeral 1 in FIG. 1) outputs a first input signal down-sampled from the input signal to a first CELP coding circuit (identified by the reference numeral 14 in FIG. 1). The first CELP coding circuit encodes the first input signal to output a encoded output to the multiplexer (identified by the reference numeral 7 in FIG. 1). The multiplexer (identified by the reference numeral 7 in FIG. 1) converts the encoded output of the first CELP coding circuit (identified by the reference numeral 14 in FIG. 1) and the second CELP coding circuit (identified by the reference numeral 15 in FIG. 1 into a bit stream for outputting. The demultiplexer (identified by the reference numeral 18 in FIG. 1) inputs the bit stream and a control signal. When the control signal indicates the low bit rate, the encoded output of the first CELP coding circuit (identified by the reference numeral 14 in FIG. 1) is output to the first CELP decoding circuit (identified by the reference numeral 16 in FIG. 1) from the bit stream. When the control signal indicates the high bit rate, a part of the encoded output of the first CELP coding circuit (identified by the reference numeral 14 in FIG. 1) and the encoded output of the second CELP coding circuit (identified by the reference numeral 15 in FIG. 1) are extracted to output to the second CELP coding circuit (identified by the reference numeral 17 in FIG. 1). Depending upon the control signal, in the first CELP decoding circuit (identified by the reference numeral 16 in FIG. 1) and the second CELP decoding circuit (identified by the reference numeral 17 in FIG. 1), the reproduced signal is decoded to output via the switch circuit 1 (identified by the reference numeral 9 in FIG. 1).

On the other hand, in the preferred embodiment, the voice coding system according to the present invention includes an adaptive code book retrieving circuit (identified by the reference numeral 147 in FIG. 6) encoding a differential pitch with respect to the pitch of the (n−1)th hierarchy and generates a corresponding adaptive code vector signal, in the (n)th hierarchy, a multipulse generating circuit (identified by the reference numeral 148 in FIG. 6) decoding n−1 in number of the multipulse signals coded up to the (n−1)th hierarchy, converting the sampling frequency of the decoded multipulse signal into the sampling frequency the same as the input signal in the (n)th hierarchy and generating the first multipulse signal derived by weighted summing of (n−1) in number of multipulse signal converted by the sampling frequency by the gain in each hierarchy, a multipulse retrieving circuit (identified by the reference numeral 149 in FIG. 6) encoding the pulse position of the second multipulse signal in the (n)th hierarchy among the pulse position candidates excluding the position of the pulse consisting the first multipulse signal, and a gain retrieving circuit (identified by the reference numeral 130 in FIG. 6) encoding the gains of the adaptive code vector signal, the first multipulse signal and the second multipulse signal.

Then, for multi-stage coding of the linear predictive coefficient, the voice coding system includes a linear predictive coefficient converting circuit (identified by the reference numeral 142 in FIG. 6) converting the linear predictive coefficient derived up to the (n−1)th hierarchy into the coefficient on the sampling frequency of the input signal at the (n)th hierarchy, a linear predictive residual difference signal generating circuit (identified by the reference numeral 143 in FIG. 6) deriving a linear predictive residual difference signal of the input signal by the converted (n−1) in number of the linear predictive coefficient, a linear predictive analyzing circuit (identified by the reference numeral 144 in FIG. 6) quantizing the newly derived linear predictive coefficient, and a target signal generating circuit (identified by the reference numeral 146 in FIG. 6) having the (n)th state audibility weighted filter. The adaptive code book retrieving circuit (identified by the reference numeral 147 in FIG. 6) has (n) stage audibility weighted reproduction filter.

Figure 6:
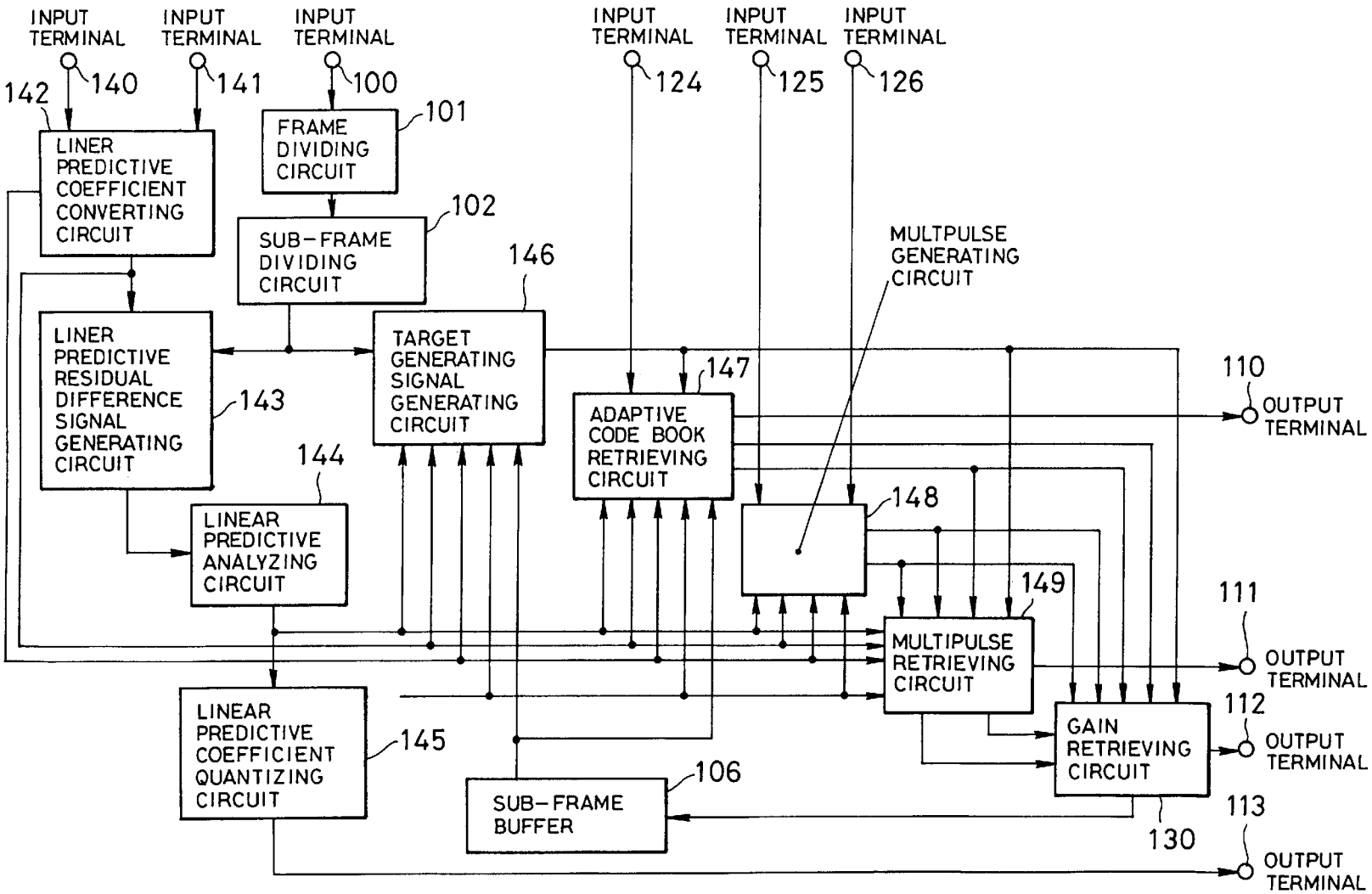
FIG. 6 is a block diagram showing a construction of a second CELP decoding circuit in the second embodiment of the voice coding and decoding system according to the invention.

In another preferred embodiment, the voice decoding system according to the present invention hierarchically varying the sampling frequency of the reproduced signal depending upon the decoded bit rate, has decoding means depending upon decodable N kinds of bit rates and the demultiplexer (identified by the reference numeral 18 in FIG. 4) selecting the (n)th hierarchy (n=1, . . . , N) among decoding means and extracting the index indicative of the linear redictive coefficient, the pitch, the multipulse signal and the gain and further includes the adaptive code book decoding circuit (identified by the reference numeral 134 in FIG. 8) decoding the pitch from the index indicative of the pitch up to the (n)th hierarchy to generate the adaptive code vector signal, the multipulse generating circuit (identified by the reference numeral 136 in FIG. 1) generating the first multipulse signal from the index indicative of the multipulse signal and the gain up to the (n−1)th hierarchy, the multipulse decoding circuit (identified by the reference numeral 135 in FIG. 8), the gain decoding circuit (identified by the reference numeral 137 in FIG. 8) decoding the gain from the index indicative of the gain of the (n)th hierarchy and generates the excitation signal from the adaptive code vector signal, the first multipulse signal, the second multipulse signal and the decoded gain, a linear predictive coefficient converting circuit (identified by the reference numeral 152 in FIG. 8) converting the linear predictive coefficient derived up to the (n−1)th hierarchy into coefficient on the sampling frequency of the input signal at the (n)th hierarchy, a reproduced signal generating circuit (identified by the reference numeral 153 in FIG. 8) generating the reproduced signal driven by the n-stage linear predictive synthesizing filter by the excitation signal and linear predictive coefficient decoding circuit (identified by the reference numeral 118 in FIG. 6) decoding a quantized linear predictive coefficient from the index input via the input terminal, to output to a reproduced signal generating circuit (identified by the reference numeral 153 in FIG. 6).

Discussion will be given hereinafter for operation of the preferred embodiments of the present invention. When pitch analysis is performed for the same voice signal with varying sampling frequencies, little variation is caused in the pitch. Accordingly, in the adaptive code book retrieving circuit coding the pitch at the (n)th hierarchy (n=2, . . . , N), coding efficiency is improved by coding only differential value relative to the pitch at the (n−1)th hierarchy.

In the preferred embodiment of the present invention, in the multipulse generating circuit at the (n)th hierarchy, the sampling frequency of the multipulse signal coded and decoded up to the (n−1)th hierarchy converts into the same sampling frequency as the input signal at the (n)th hierarchy to generate the first multipulse signal derived by weighted summing of the n−1 multipulse signals sampling frequencies of which are converted, by the gains at each hierarchy. In the multipulse retrieving circuit at the (n)th hierarchy, among the pulse position candidate excluding the position of the pulse consisting the first multipulse signal, the pulse position of the second multipulse signal at the (n)th hierarchy may be coded to contribute for reducing of number of the bits.

On the other hand, since the gains up to the (n)th hierarchy are multiplied in the first multipulse signal, the gain in the first multipulse signal in the gain retrieving circuit at the (n)th hierarchy may be coded as a ratio with respect to the gain up to the (n)th hierarchy, coding efficiency can be improved.

In the linear predictive coefficient converting circuit (identified by the reference numeral 142 in FIG. 6) at the (n)th hierarchy, the quantized linear predictive coefficient coded and decoded up to the (n−1)th hierarchy are converted into coefficient on the same sampling frequencies as the input signal at the (n)th hierarchy. In the linear predictive residual difference signal generating circuit (identified by the reference numeral 143 in FIG. 6), by a (n−1)-stages of linear predictive inverted filter using the converted linear predictive coefficient, the linear predictive residual difference signal of the input signal is generated. In the linear predictive analyzing circuit (identified by the reference numeral 144 in FIG. 6), the linear predictive coefficient relative to the linear predictive residual difference signal is newly derived. In the linear predictive coefficient quantization circuit (identified by the reference numeral 145 in FIG. 6), the derived linear predictive coefficient is quantized.

By this, among the input signal, since a band spectrum envelop coded at the (m)th hierarchy (m=1, . . . , n−1) can be expressed by the linear predictive coefficient coded at the (m)th hierarchy, it becomes unnecessary to newly transmit the code at the (n)th hierarchy. Accordingly, the linear predictive coefficient newly obtained through analysis may be expressed only the spectrum envelop of the in other band and thus can be transmitted with smaller number of bits.

In the target signal generating circuit, n-stage audibility weighted filter is used. In the adaptive code book retrieving circuit and the multipulse retrieving circuit, the n-stage audibility weighted reproduction filter is used. On the other hand, in the reproduced signal generating circuit, by using the n-stage linear predictive synthesizing filter, the spectrum envelop of the input signal of the (n)th hierarchy can be expressed. Accordingly, coding of the pitch and the multipulse signal can be realized by the audibility weighted reproduction signal to improve quality of the reproduced signal.

For discussion of the preferred embodiment of the present invention in detail, embodiments of the present invention will be discussed with reference to the drawings.

FIG. 1 is a block diagram showing a construction of the first embodiment of a voice coding and decoding system according to the present invention.

Referring to FIG. 1, the first embodiment of the voice coding and decoding system according to the present invention will be discussed. For simplification of disclosure, the following discussion will be given for the case where number of hierarchies is two. It should be noted that the similar discussion will be applicable for the case where the number of the hierarchies is three or more. In FIG. 1, a bit stream coded by the voice coding system is decoded by two kinds of bit rates (hereinafter referred to as high bit rate and low bit rate).

Referring to FIG. 1, the down-sampling circuit 1 outputs the first input signal (e.g. sampling frequency 8 kHz) down-sampled from the input signal (e.g. sampling frequency 16 kHz), to the first CELP coding circuit 14.

Figure 13:
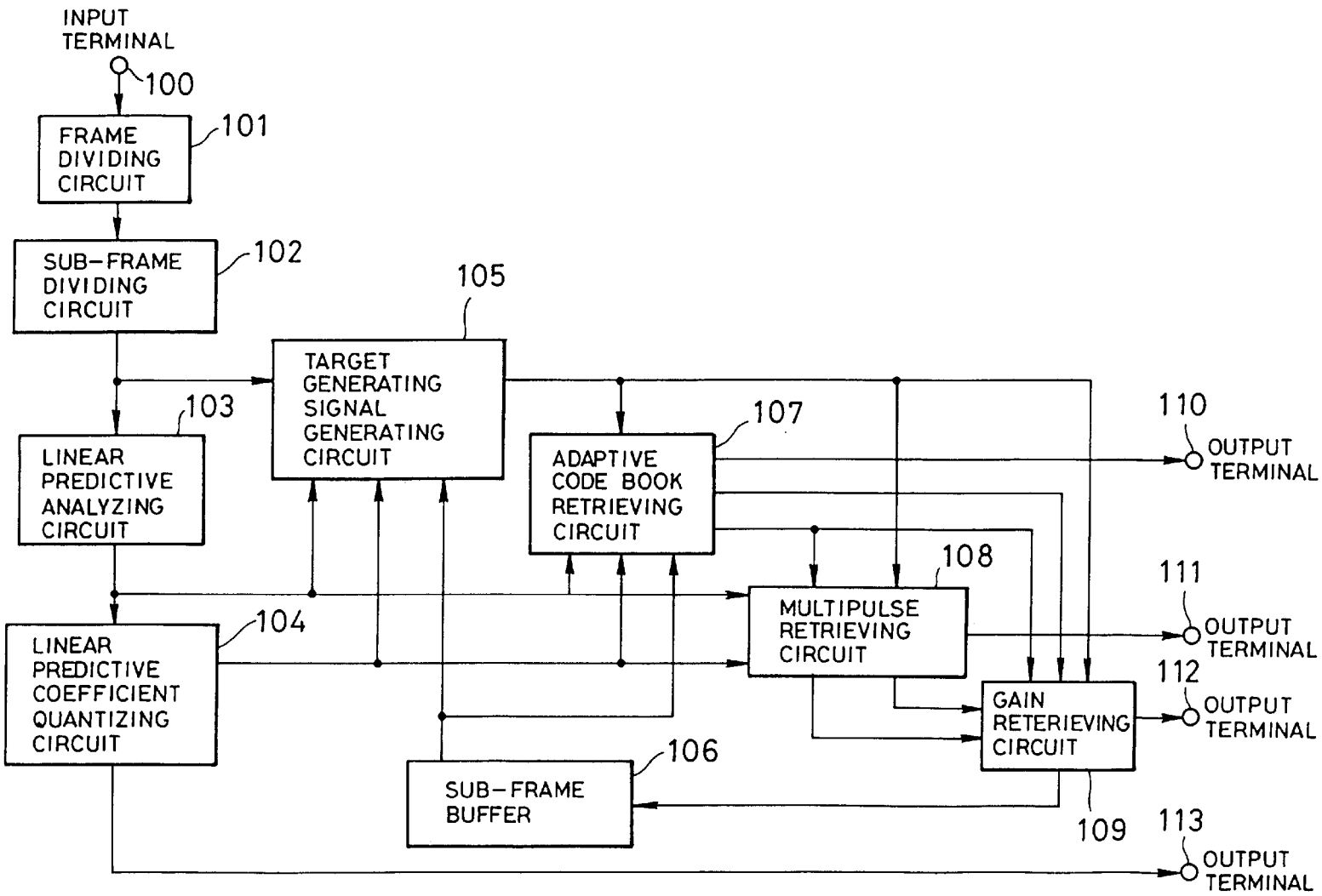
FIG. 13 is a block diagram showing an example of construction of a CELP coding circuit.

The first CELP coding circuit codes the first input signal in the similar manner as that of the CELP coding circuit shown in FIG. 13 to output the index ILd of the adaptive code vector, the index ILj of the multipulse signal and the index ILk of the gain to the second CELP coding circuit 15 and the multiplexer 7, and the index ILa corresponding to the linear predictive coefficient to the multiplexer 7.

Figure 2:
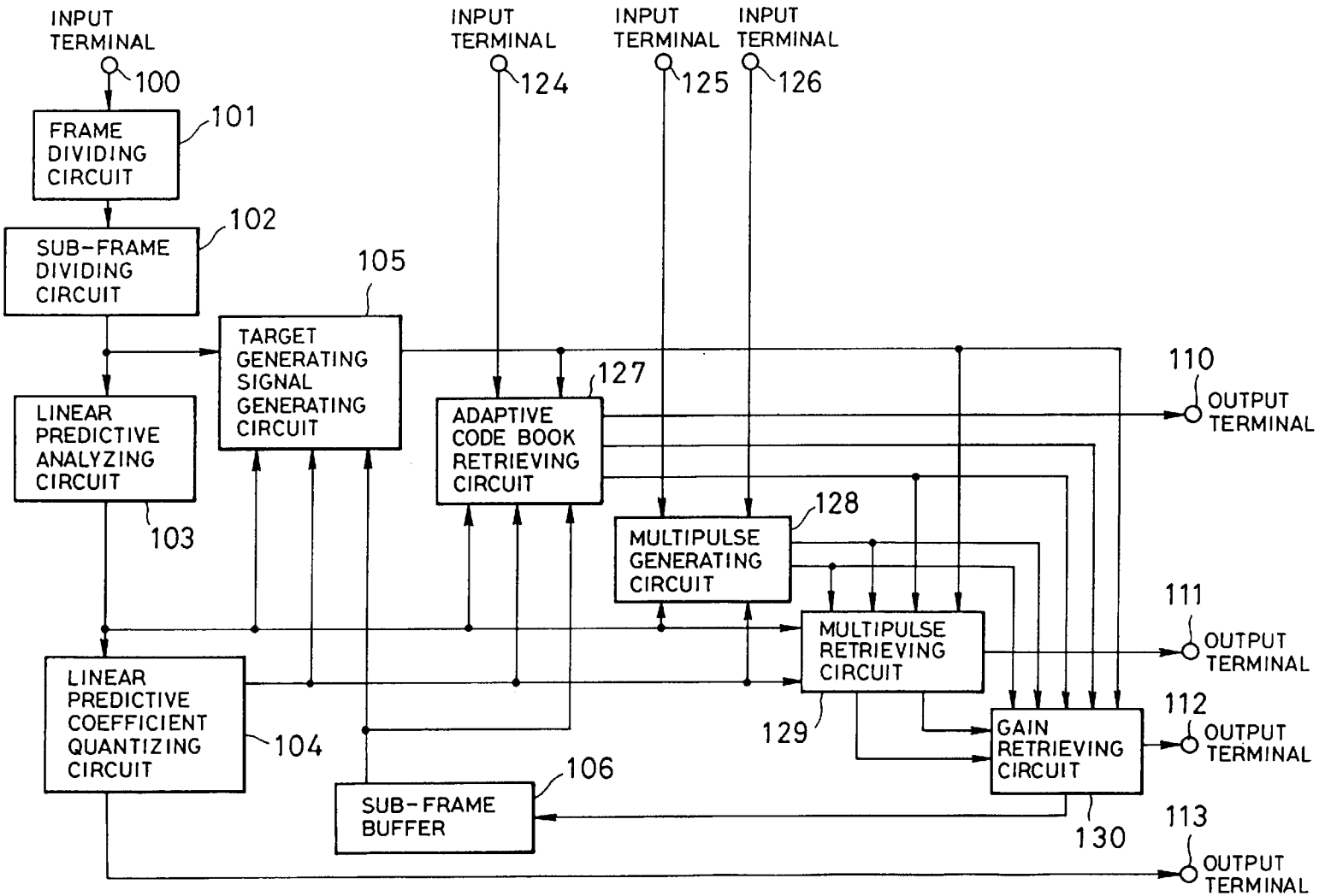
FIG. 2 is a block diagram showing a construction of a second CELP coding circuit in the first embodiment of the voice coding and decoding system according to the invention.

FIG. 2 is a block diagram showing the second CELP coding circuit 15 in the first embodiment of the voice coding and decoding system according to the present invention. Referring to FIG. 2, detailed discussion will be given for the second CELP coding circuit 15. In comparison with the conventional CELP coding circuit shown in FIG. 13, the operations of the adaptive code book retrieving circuit 127, the multipulse generating circuit 128, the multipulse retrieving circuit 129 and the gain retrieving circuit 130 are differentiated. Hereinafter, discussion for these circuit will be given hereinafter.

In the adaptive code book retrieving circuit 127, from the index ILd obtained via the input terminal 124, the pitch d' in the first CELP coding circuit 14 is decoded and converted into a first pitch d1 corresponding to the sampling frequency of the input signal of the second CELP coding circuit 15. For example, when the sampling frequency is converted from 8 kHz to 16 kHz, d1=2d' is established. Also, among a retrieving range (e.g. d1−8, . . . , d1+7) centered at the first pitch d1, a second pitch d2 where the error expressed by the foregoing equation (3) becomes minimum, is selected in the similar manner as the adaptive code book retrieving circuit 107 of FIG. 13.

On the other hand, the adaptive code book retrieving circuit 127 takes the differential value of the selected second pitch d2 and the first pitch d1 as the differential pitch, and output to the output terminal 110 after conversion into the index Id. On the other hand, the selective adaptive code vector signal Ad(n) is output to the gain retrieving circuit 130 and the reproduced signal SAd(n) thereof is output to the gain retrieving circuit 130 and the multipulse retrieving circuit 129.

In the multipulse generating circuit 128, the first multipulse is generated on the basis of the multipulse coded by the first CELP coding circuit 14. On the basis of the index ILj of the multipulse signal and the index ILk of the gain in the first CELP coding circuit 14 obtained via the input terminals 125 and 126, the first multipulse signal DL(n), n=0, . . . , N−1 is expressed by the following equation (7).

$$DL(n)=Gk(0)Cj'(n),\ n=0, \ldots, N-1 \tag{7}$$

where Cj'(n) is a signal converted the sampling frequency from the multipulse signal in the first CELP coding circuit 14. For example, as one example of the case where the sampling frequency is converted from 8 kHz to 16 kHz, Cj'(n) is expressed by the following equation (8).

$$Cj(n) = \sum_{p=0}^{p'-1} A(p)\cdot\delta(n-2M(p)) \tag{8}$$

$$n = 0, \ldots, N-1$$

wherein, A(p) and M(p) are amplitude and position of the pulse in (p)th sequential order consisting the multipulse in the first CELP coding circuit 14, P' is number of pulses. On the other hand, as an alternative embodiment, upon deriving Cj'(n), it is possible to take fluctuation of the pulse position into account. In this case, Cj'(n) is expressed by the following equation (9).

$$Cj(n) = \sum_{p=0}^{p'-1} A(p) \cdot \delta(n - (2M(p) + D)) \quad (9)$$

$$n = 0, \ldots, N-1$$

wherein D represents the fluctuation of the pulse position in the sampling frequency conversion of the multipulse signal. In the shown example, D is either 0 or 1. Accordingly, as candidate of the first multipulse signal, two signals are present. Also, it is possible to take the fluctuation of the pulse position per every pulse. In such case, Cj'(n) may be expressed by replacing D in the foregoing equation (9) with D(p), p=0, . . . p'−1.

In this example, as the candidate of the first multipulse signal, 2^p' in number (p' in number of 2 to (^)th power) are present. In either case, the first multipulse signal DL(n) is selected among these candidates so that the error in the foregoing equation (4) becomes minimum similarly to the multipulse retrieving circuit 108 shown in FIG. 13.

On the other hand, the multipulse generating circuit 128 outputs the first multipulse signal DL(n) and the reproduced signal SDL(n) thereof to the gain retrieving circuit 130 and the multipulse retrieving circuit 129.

In the multipulse retrieving circuit 129, the second multipulse signal orthogonal with respect to the first multipulse signal and the adaptive code vector signal is newly retrieved. At first, the pulse position candidates for retrieving the second multipulse signal are set so that the positions of the pulses consisting the first multipulse signal and the positions of the pulses consisting the second multipulse signal will never overlap. For example, when the first multipulse signal is generated on the basis of the foregoing equation (8), assuming a sub-frame length N=80 and pulse number P=5, the pulse position candidates shown in FIG. 16 are used.

On the basis of the set pulse position candidates, the second multipulse signal is coded so that the error E4(j) expressed by the following equation (10) becomes minimum similarly to the multipulse retrieving circuit 108 shown in FIG. 13.

$$E4(j) = \sum_{n=0}^{N-1} X''(n)^2 - \frac{\left(\sum_{n=0}^{N-1} X''(n) \cdot scj(n)\right)^2}{\sum_{n=0}^{N-1} scj(n)^2} \quad (10)$$

wherein X"(n), n=0, . . . , N−1 are derived by orthgonalization of the target signal X(n) by the reproduced signal SAd(n) of the adaptive code vector signal and the reproduced signal SDL(n) of the first multipulse signals which is derived by the following equation (11).

$$X'(n) = X(n) - OGa \cdot SAd(n) - OGc \cdot SDL(n)$$

$$OGa = \frac{\sum_{n=0}^{N-1} X(n) \cdot SAd(n) \cdot \sum_{n=0}^{N-1} SDL(n)^2 - \sum_{n=0}^{N-1} X(n) \cdot SDL(n) \cdot \sum_{n=0}^{N-1} SAd(n) \cdot SDL(n)}{\sum_{n=0}^{N-1} SAd(n)^2 \cdot \sum_{n=0}^{N-1} SDL(n)^2 - \left(\sum_{n=0}^{N-1} SAd(n) \cdot SDL(n)\right)^2} \quad (11)$$

$$OGc = \frac{\sum_{n=0}^{N-1} X(n) \cdot SDL(n) \cdot \sum_{n=0}^{N-1} SAd(n)^2 - \sum_{n=0}^{N-1} X(n) \cdot SAd(n) \cdot \sum_{n=0}^{N-1} SAd(n) \cdot SDL(n)}{\sum_{n=0}^{N-1} SAd(n)^2 \cdot \sum_{n=0}^{N-1} SCj(n)^2 - \left(\sum_{n=0}^{N-1} SAd(n) \cdot SCj(n)\right)^2}$$

On the other hand, the multipulse retrieving circuit 129 outputs the second multipulse signal Cj(n) and the reproduced signal SCj(n) thereof to the gain retrieving circuit 130 and the corresponding index to the output terminal 111.

In the gain retrieving circuit 130, the gains of the adaptive code vector signal, the first multipulse signal and the second multipulse signal are a three-dimensional vector quantized. The gains of the adaptive code vector signal, the first multipulse signal and the second multipulse signal accumulated in the gain code book of a code book size K are assumed to be Gkx(0), Gkx(1), Gkx(2), kx=0, . . . , K−1. An index k of an optimal gain is selected so that an error E5(k) expressed by the following equation (12) using the reproduced signal SAd(n) of the adaptive code vector, the reproduced signal SDL(n) of the first multipulse, the reproduced signal SCj (n) of the second multipulse and the target signal X(n), can be minimized. The gains of the adaptive code vector signal, the first multipulse signal and the second multipulse signal of the selected index k are assumed to be Gk(0), Gk(1) and Gk(2), respectively.

$$E5(kx) = \sum_{n=0}^{N-1} (X(n) - Gkx(0) \cdot SAd(n) - Gkx(1) \cdot SDL(n) - Gkx(2) \cdot SCj(n))^2 \quad (12)$$

On the other hand, the excitation signal is generated using the selected gain, the adaptive code vector, the first multipulse signal and the second multipulse signal and output to the sub-frame buffer 106, and the index corresponding to the gain is output to the output terminal 112.

Referring again to FIG. 1, discussion will be given for the shown embodiment of the voice coding system. The multiplexer 7 converts the four kinds of the indexes input from the first CELP coding circuit 14 and the four kinds of the indexes input from the second CELP coding circuit 15 into the bit stream for outputting.

Next, discussion will be given for the voice decoding system. The voice decoding system switches its operation by the demultiplexer 18 and the switch circuit 19 depending upon the control signal identifying two kinds of bit rates decordable by the voice decoding system.

The demultiplexer 18 inputs the bit stream and the control signal. When the control signal is low bit rate, the coded indexes ILd, ILj, ILk and ILa are extracted from the bit stream in the first CELP coding circuit 14 to output to the first CELP decoding circuit 16. On the other hand, when the control signal is high bit rate, the indexes ILd, ILj and ILk among the four kinds of indexes coded in the first CELP coding circuit 14 and the indexes Id, Ij, Ik and Iz coded in the second CELP coding circuit 15 are extracted to output to the second CELP decoding circuit 17.

The first CELP decoding circuit 16 decodes respective of the adaptive code vector, the multipulse signal, the gain and the linear predictive coefficient from the index ILd of the adaptive code vector, the index ILj of the multipulse signal, the index ILk of the gain and the index ILa corresponding to the linear predictive coefficient to generate the first reproduced signal for outputting to the switch circuit 19.

The second CELP decoding circuit 17 decodes the second reproduced signal from the indexes ILd, ILj and ILk coded in the first CELP coding circuit 14 and indexes Id, Ij, Ik and Ia coded in the second CELP coding circuit 15 for outputting to the switch circuit 19.

Figure 3:
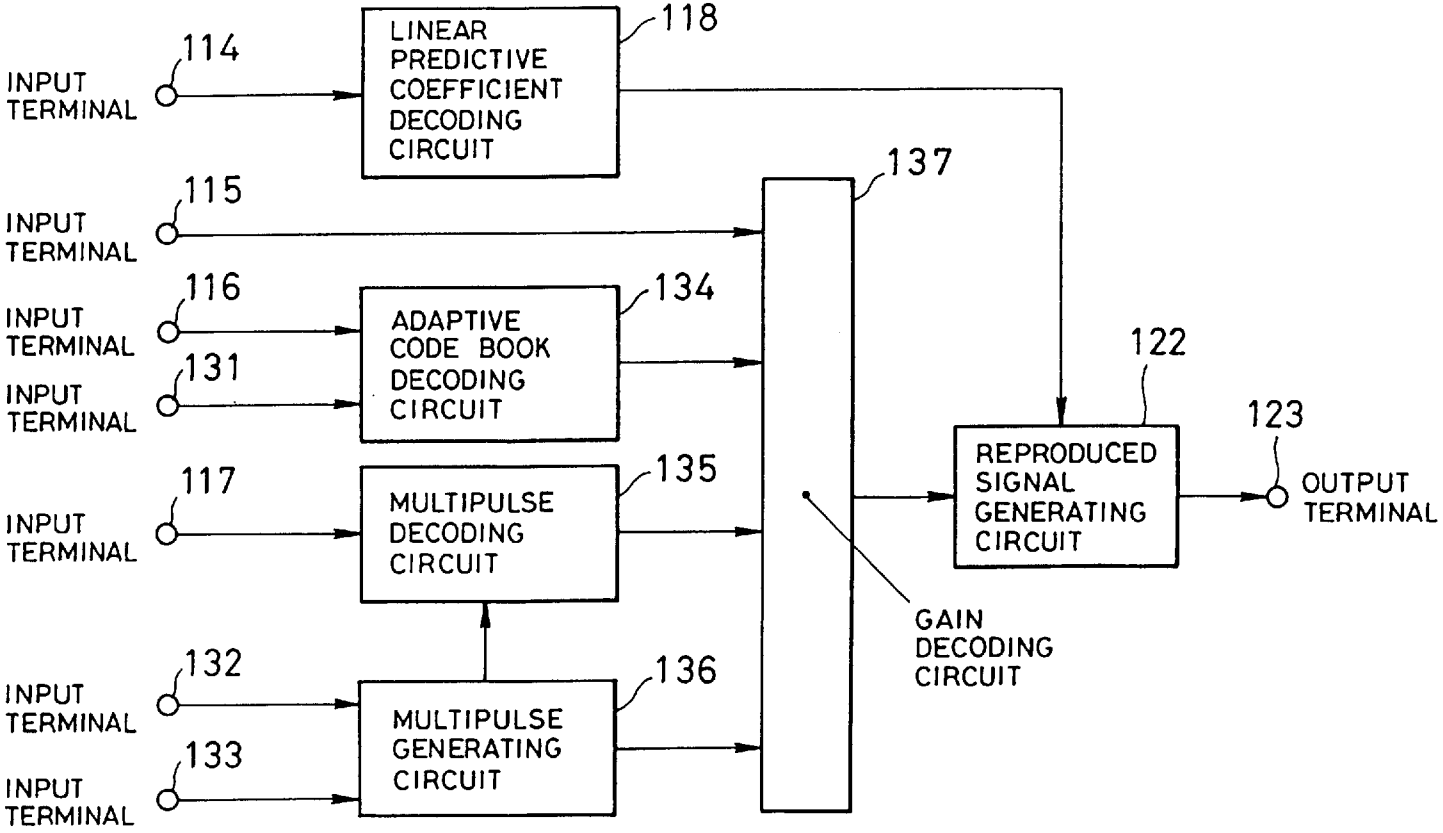
FIG. 3 is a block diagram showing a construction of a second CELP decoding circuit in the first embodiment of the voice coding and decoding system according to the invention.

FIG. 3 is a block diagram showing the second CELP decoding circuit 17 in the first embodiment of the voice coding and decoding system according to the present invention. Discussion will be given hereinafter with respect to the second CELP decoding circuit 17 with reference to FIG. 3. The second CELP decoding circuit 17 is differentiated in operations of an adaptive code book decoding circuit 134, a multipulse decoding circuit 135, a multipulse generating circuit 136 and a gain decoding circuit 137, in comparison with the CELP decoding circuit shown in FIG. 14. Hereinafter, operations of these circuits will be discussed.

In the adaptive code book decoding circuit 134, a first pitch d1 is derived from the index ILd input via an input terminal 131 in similar manner to the adaptive code book retrieving circuit 127. A differential pitch decoded from the index ILd input via an input terminal 116 and the first pitch d1 are summed to decode a second pitch d2. On the basis of the decoded second pitch d2, an adaptive code vector signal Ad(n) is derived to output to a gain decoding circuit 137.

In the multipulse generating circuit 136, the first multipulse signal DL(n) is decoded from the indexes ILj and ILk input via the input terminals 132 and 133 in similar manner to the multipulse generating circuit 128 to output to the gain decoding circuit 137 and the multipulse decoding circuit 137.

In the multipulse decoding circuit 135, the pulse position candidate (shown in FIG. 16) for decoding the second multipulse signal is generated using the first multipulse signal in similar manner to the multipulse retrieving circuit 129. On the basis of the generated pulse position candidate, the second multipulse signal Cj(n) is decoded from the index Id input via the input terminal 117. Then, the decoded second multipulse signal DL(n) is output to the gain decoding circuit 137.

In the gain decoding circuit 137, the gains Gk(0), Gk(1) and Gk(3) are decoded from the index Ik input via the input terminal 115, and the excitation signal is generated using the adaptive code vector signal Ad(n), the first multipulse signal DL(n), the second multipulse signal Cj(n) and the gains GA(k), GC1(k) and GC2(k) to output to a reproduced signal generating circuit 122.

Referring again to FIG. 1, the shown embodiment of the voice decoding system will be discussed. The switch 19 inputs the first reproduced signal, the second reproduced signal and the control signal. When the control signal is high bit rate, the input second reproduced signal is output to the voice coding system as the reproduced signal. On the other hand, the control signal is low bit rate, the input first reproduced signal is output to the voice coding system as the reproduced signal.

While the foregoing first embodiment of the voice coding and decoding system according to the present invention has been discussed hereabove in terms of multi-stage coding of the pitch, the multipulse signal and the gain, similar discussion will be applicable even for the case where either one of the multipulse signal and the gain is subject to multi-stage coding.

Figure 4:
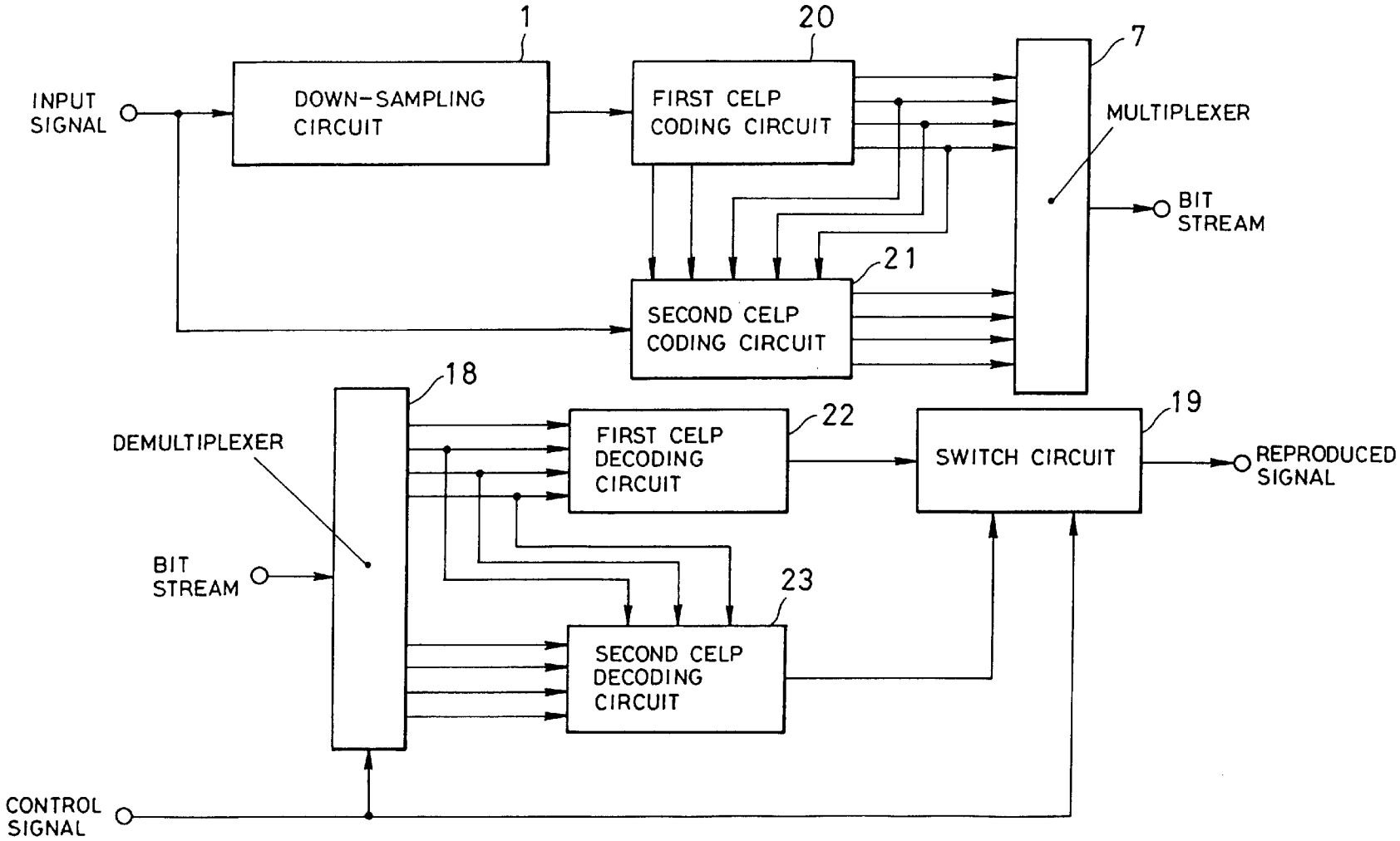
FIG. 4 is a block diagram showing a construction of the second embodiment of a voice coding and decoding system according to the present invention.

FIG. 4 is a block diagram showing a construction of the second embodiment of the voice coding and decoding system according to the present invention. Referring to FIG. 4, the second embodiment of the voice coding and decoding system will be discussed. For simplification of the disclosure, the following discussion will be given in terms of the case where number of hierarchies is two. It should be noted that similar discussion is applicable for the case where the number of hierarchies is three or more.

In the shown embodiment, the bit stream coded by the voice coding system is decoded at two kinds of bit rates (hereinafter referred to as "high bit rate" and "low bit rate").

The second embodiment of the voice coding and decoding system according to the present invention is differentiated only in the first CELP coding circuit 20, the second CELP coding circuit 21, the first CELP decoding circuit 22 and the second CELP decoding circuit 23 in comparison with the first embodiment. Therefore, the following disclosure will be concentrated for these circuits different from those in the first embodiment in order to keep the disclosure simple enough by avoiding redundant discussion and whereby to facilitate clear understanding of the present invention.

The first CELP coding circuit 20 codes the first input signal input from the down-sampling circuit 1 for outputting the index ILd of the adaptive code vector, the index ILj of the multipulse signal and the index ILk of the gain to the second CELP coding circuit 21 and the multiplexer 7, and for outputting the index ILa corresponding to the linear predictive coefficient to the multiplexer 7, and the linear predictive coefficient and the quantized linear predictive coefficient to the second CELP coding circuit 21.

Figure 5:
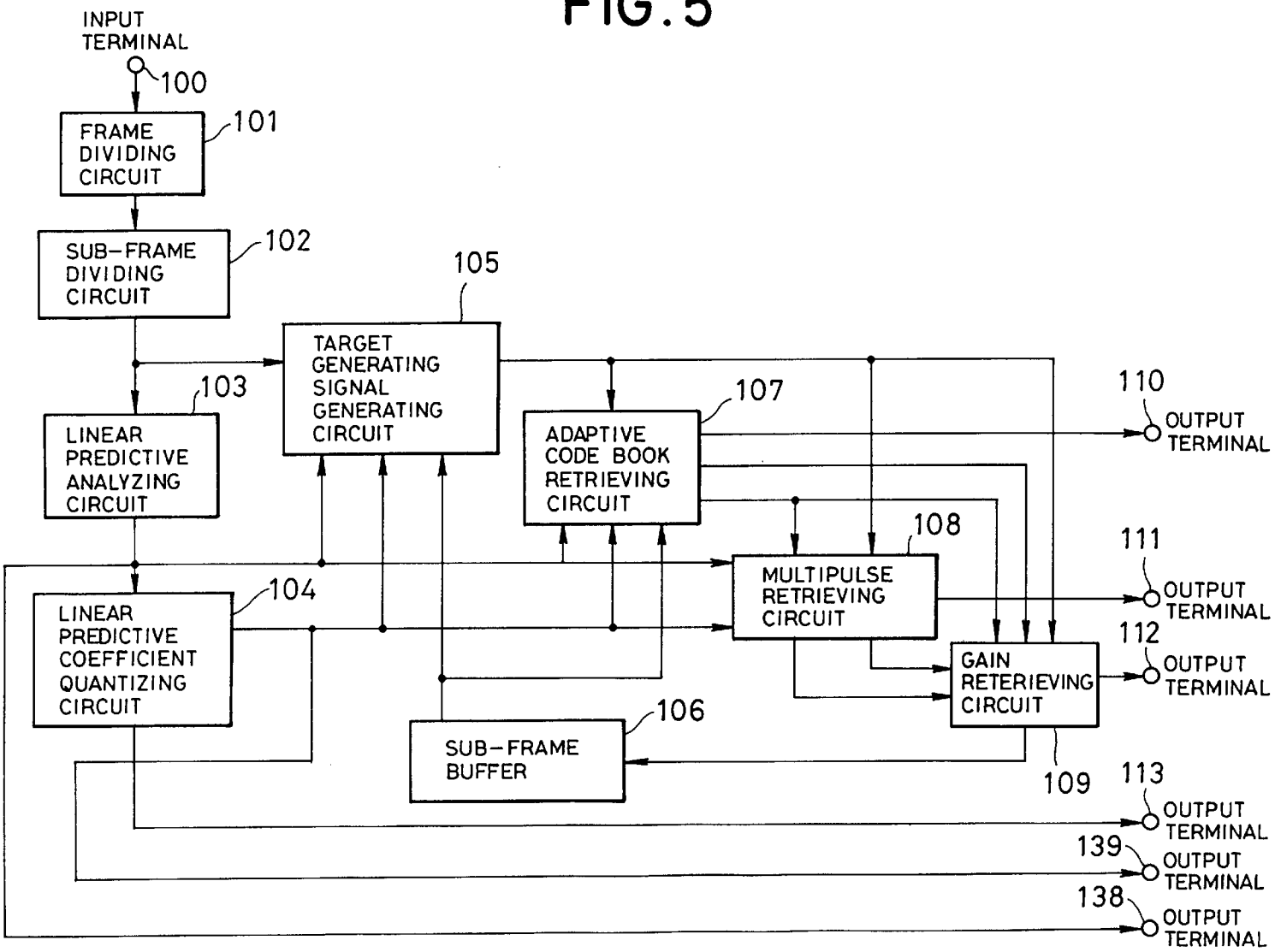
FIG. 5 is a block diagram showing a construction of a first CELP coding circuit in the second embodiment of the voice coding and decoding system according to the invention.

FIG. 5 is a block diagram showing a construction of the first CELP coding circuit 20 in the second embodiment of the voice coding and decoding system according to the present invention. Referring to FIG. 5, difference between the first CELP coding circuit 20 of the shown embodiment and the CELP coding circuit shown in FIG. 13 will be discussed.

In the first CELP coding circuit 20, in comparison with the CELP coding circuit shown in FIG. 13, it is only differentiated in outputting the linear predictive coefficient as output of the linear predictive analyzing circuit 103 and the quantized linear predictive coefficient as output of the linear predictive coefficient quantizing circuit 104 to the output terminals 138 and 139. Accordingly, discussion of the operation of the circuit forming the first CELP coding circuit 20 will be neglected.

Referring again to FIG. 4, the second CELP coding circuit 21 codes the input signal on the basis of three kinds of indexes ILd, ILj and ILk as output of the first CELP coding circuit 20, the linear predictive coefficient and the quantized linear predictive coefficient to output the index Id of the adaptive code vector, the index Ij of the multipulse signal, the index Ik of the gain and the index Ia corresponding to the linear predictive coefficient, to the multiplexer 7.

FIG. 6 is a block diagram showing a construction of the second CELP coding circuit 21. Referring to FIG. 6, discussion will be given with respect to the second CELP coding circuit 21. A frame dividing circuit 101 divides the input signal input via the input terminal 100 per frame to output to a sub-frame dividing circuit 102.

The sub-frame dividing circuit 102 further divides the input signal in the frame into sub-frames to output to a linear predictive residual signal generating circuit 143 and a target signal generating circuit 146. A linear predictive coefficient converting circuit 142 inputs the linear predictive coefficient and the quantized linear predictive coefficient derived by the first CELP coding circuit 20 via the input terminals 140 and 141 and converts into a first linear predictive coefficient and a first quantized linear predictive coefficient corresponding to a sampling frequency of the input signal of the second CELP coding circuit 21.

Sampling frequency conversion of the linear predictive coefficient may be performed by deriving an impulse response signal of a linear predictive synthesizing filter of the same configuration as the foregoing equation (2) with respect to respective linear predictive coefficient and the quantized linear predictive coefficient, and after up-sampling (the same operation as that of the up-sampling circuit 4 of the prior art) of the impulse response signal, auto-correlation is derived to apply a linear predictive analyzing method.

On the other hand, the linear predictive coefficient converting circuit 142 outputs the first linear predictive coefficients al(i), i=1, . . . , Np to the linear predictive residual difference signal generating circuit 143, the target signal generating circuit 146, the adaptive code book retrieving circuit 147, the multipulse generating circuit 148 and the multipulse retrieving circuit 149 and also outputs the first quantized linear predictive coefficient a1'(i), i=1, . . . , Np to the target signal generating circuit 146, the adaptive code book retrieving circuit 147, the multipulse generating circuit 148 and the multipulse retrieving circuit 149.

In the linear predictive residual difference signal generating circuit 143, the linear predictive inverted-filter (see the following equation (13)) is driven by the input signal input from the sub-frame dividing circuit 102 to derive the linear predictive residual difference signal to output to the linear predictive analyzing circuit 144.

$$As(z) = 1 - \sum_{i=1}^{Np} al(i) \cdot z^{-i} \tag{13}$$

The linear predictive analyzing circuit 144 performs linear predictive analysis of the linear predictive residual difference signal in the similar manner as the linear predictive analyzing circuit 103 shown in FIG. 13 to output a second linear predictive coefficients aw(i), i=1, . . . , Np' to the linear predictive coefficient quantizing circuit 145, the target signal generating circuit 146, the adaptive code book retrieving circuit 147, the multipulse generating circuit 148 and the multipulse retrieving circuit 149. Here, Np' is order of the linear predictive analysis, e.g. "10" in the shown embodiment.

In the linear predictive coefficient quantizing circuit 145, similarly to the linear predictive coefficient quantizing circuit 104 shown in FIG. 13, quantizes the second linear predictive coefficient to output the second quantized linear predictive coefficient aw'(i), i=1, . . . , Np' to the target signal generating circuit 146, the adaptive code book retrieving circuit 147, the multipulse generating circuit 148 and the multipulse retrieving circuit 149, and to output the index indicative of the second quantized linear predictive coefficient to the output terminal 113.

In the target signal generating circuit 146, the audibility weighted filter Hw'(z) expressed by the following quation (14) is driven by the input signal input from the ub-frame dividing circuit 102 to generate an audibility eighted signal.

$$Hw'(z) = \frac{1 - \sum_{i=1}^{Np} al(i) \cdot R2^i \cdot z^{-i}}{1 - \sum_{i=1}^{Np} al(i) \cdot R1^i \cdot z^{-i}} \cdot \frac{1 - \sum_{i=1}^{Np'} aw(i) \cdot R4^i \cdot z^{-i}}{1 - \sum_{i=1}^{Np'} aw(i) \cdot R3^i \cdot z^{-i}} \tag{14}$$

wherein, R1, R2, R3 and R4 are weighting coefficient controlling the audibility weighted amount. For example, R1=R3=0.6 and R2=R4=0.9.

Next, an audibility weighted synthesizing filter Hsw'(z), in which the linear predictive synthesizing filter (see the following equation (15)) of the immediately preceding sub-frame and the audibility weighted filter Hw'(z) are connected in cascade connection, is driven by the excitation signal of the immediately preceding sub-frame obtained via the sub-frame buffer 106. Subsequently, the filter coefficient of the audibility weighted synthesizing filter is varied to the value of the current sub-frame. Then, using a zero input signal having all of signal values being zero, the audibility weighted synthesizing filter is driven to derive a zero input response signal.

$$Hs'(z) = \frac{1}{1 - \sum_{i=1}^{Np} al'(i) \cdot z^{-i}} \cdot \frac{1}{1 - \sum_{i=1}^{Np'} aw'(i) \cdot z^{-i}} \tag{15}$$

Also, the zero input response signal is subtracted from the audibility weighted signal to generate the target signal X(n), n=0, . . . , N−1. Here, N is a sub-frame length. On the other hand, the target signal X(n) is output to the adaptive code book retrieving circuit 147, the multipulse retrieving circuit 149 and the gain retrieving circuit 130.

In the adaptive code book retrieving circuit 147, similarly to the adaptive code book retrieving circuit 127 (see FIG. 2) in the first embodiment, the first pitch d1 is derived from the index ILd obtained via the input terminal 124. Also, among a retrieving range centered at the first pitch d1, the second pitch d2 where the error expressed by the foregoing equation (3) becomes minimum, is selected. As the audibility weighted synthesizing filter in the zero state, a filter Zsw'(z) established by initializing the audibility weighted synthesizing filter Hsw'(Z) per sub-frame is employed.

Then, the adaptive code book retrieving circuit 147 takes a differential value of the selected second pitch d2 and the first pitch d1 as the differential pitch, and output to the output terminal 110 after conversion into the index Id. On the other hand, the selected adaptive code vector signal Ad(n) is output to the gain retrieving circuit 130 and the reproduced signal SAd(n) is output to the gain retrieving circuit 130 and the multipulse retrieving circuit 149.

In the multipulse generating circuit 148, similarly to the multipulse generating circuit 128 in the first embodiment, the first multipulse signal DL(n) is generated on the basis of the multipulse signal coded by the first CELP coding circuit 20. On the other hand, employing the audibility weighted synthesizing filter Zsw'(z) in zero state. the reproduced signal SDL(n) of the first multipulse signal is generated to output the first multipulse signal and the reproduced signal thereof to the gain retrieving circuit 130.

In the multipulse retrieving circuit 149, similarly to the multipulse retrieving circuit 129 in the first embodiment, the second multipulse signal orthogonal to the first multipulse signal and the adaptive code vector signal is newly retrieved employing the audibility weighted synthesizing filter Zsw'(z) in zero state. On the other hand, the multipulse retrieving circuit 149 outputs the second multipulse signal Cj(n) and the reproduced signal SCj(n) thereof to the gain retrieving circuit 130 and outputs the corresponding index to the output terminal 111.

Figure 7:
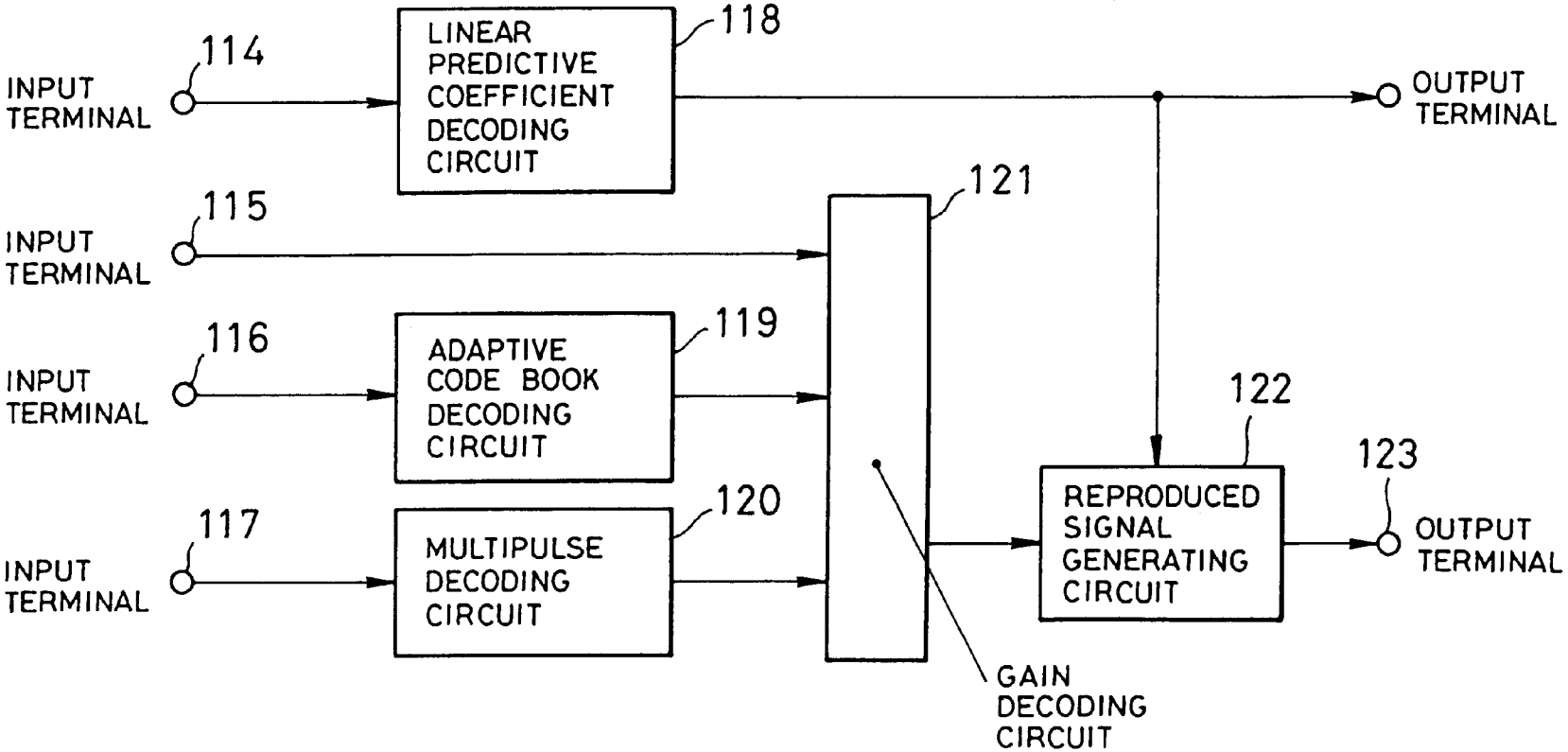
FIG. 7 is a block diagram showing a construction of a first CELP decoding circuit in the second embodiment of the voice coding and decoding system according to the invention.

Hereinafter, the voice decoding system will be discussed. FIG. 7 is a block diagram showing a construction of the first CELP decoding circuit in the second embodiment of the voice coding and decoding system according to the present invention. Referring to FIG. 7, discussion will be given for a difference between the first CELP decoding circuit 22 and the CELP decoding circuit shown in FIG. 14.

Figure 14:
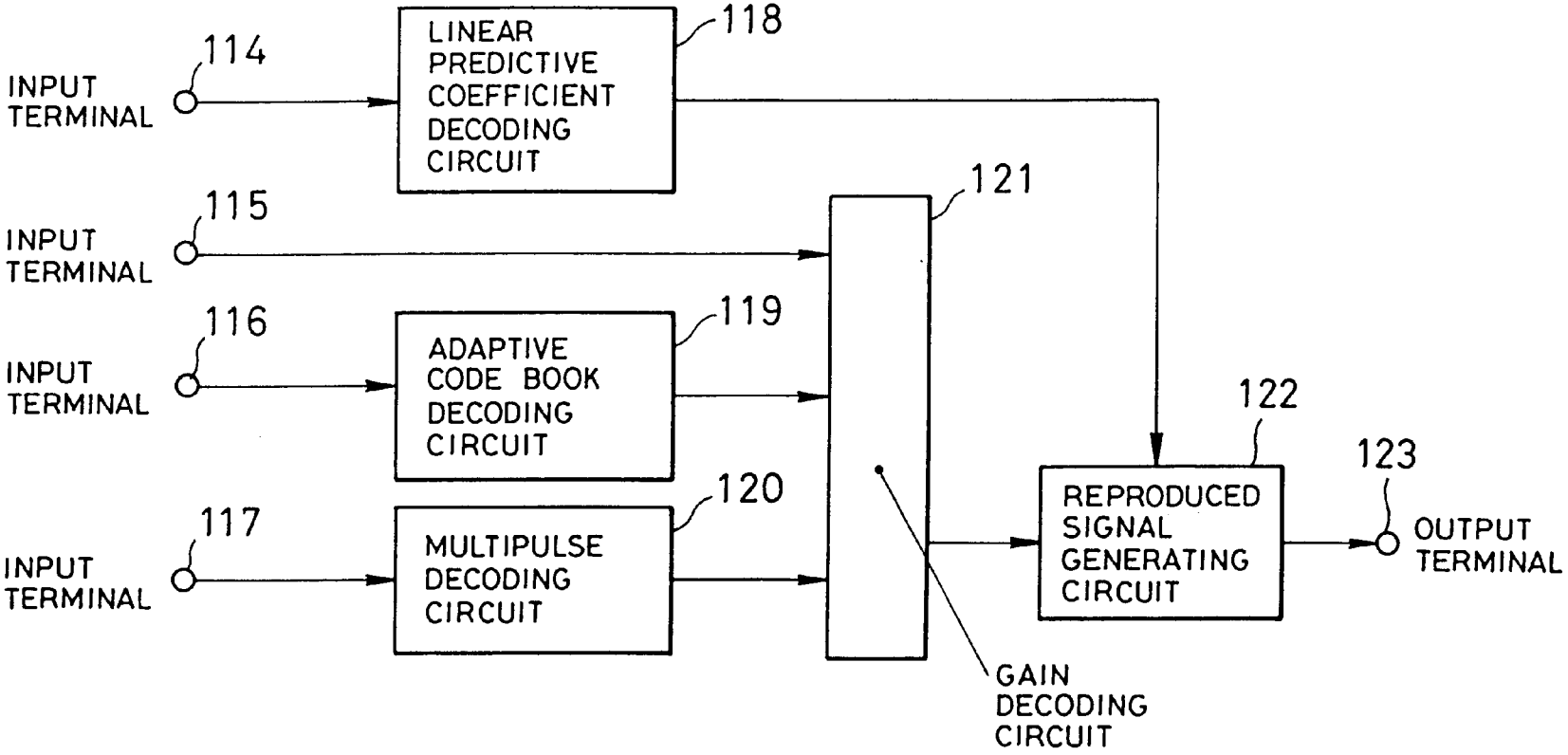
FIG. 14 is a block diagram showing an example of construction of a CELP decoding circuit.

The first CELP decoding circuit 22 is differentiated from the CELP decoding circuit shown in FIG. 14 only in that the quantized linear predictive coefficient as the output of the linear predictive coefficient decoding circuit 118 is taken as the output of the output terminal 150. Accordingly, the operation of the circuit forming the first CELP decoding circuit 22 will not be discussed in order to keep the disclosure simple enough by avoiding redundant discussion and to facilitate clear understanding of the present invention.

Figure 8:
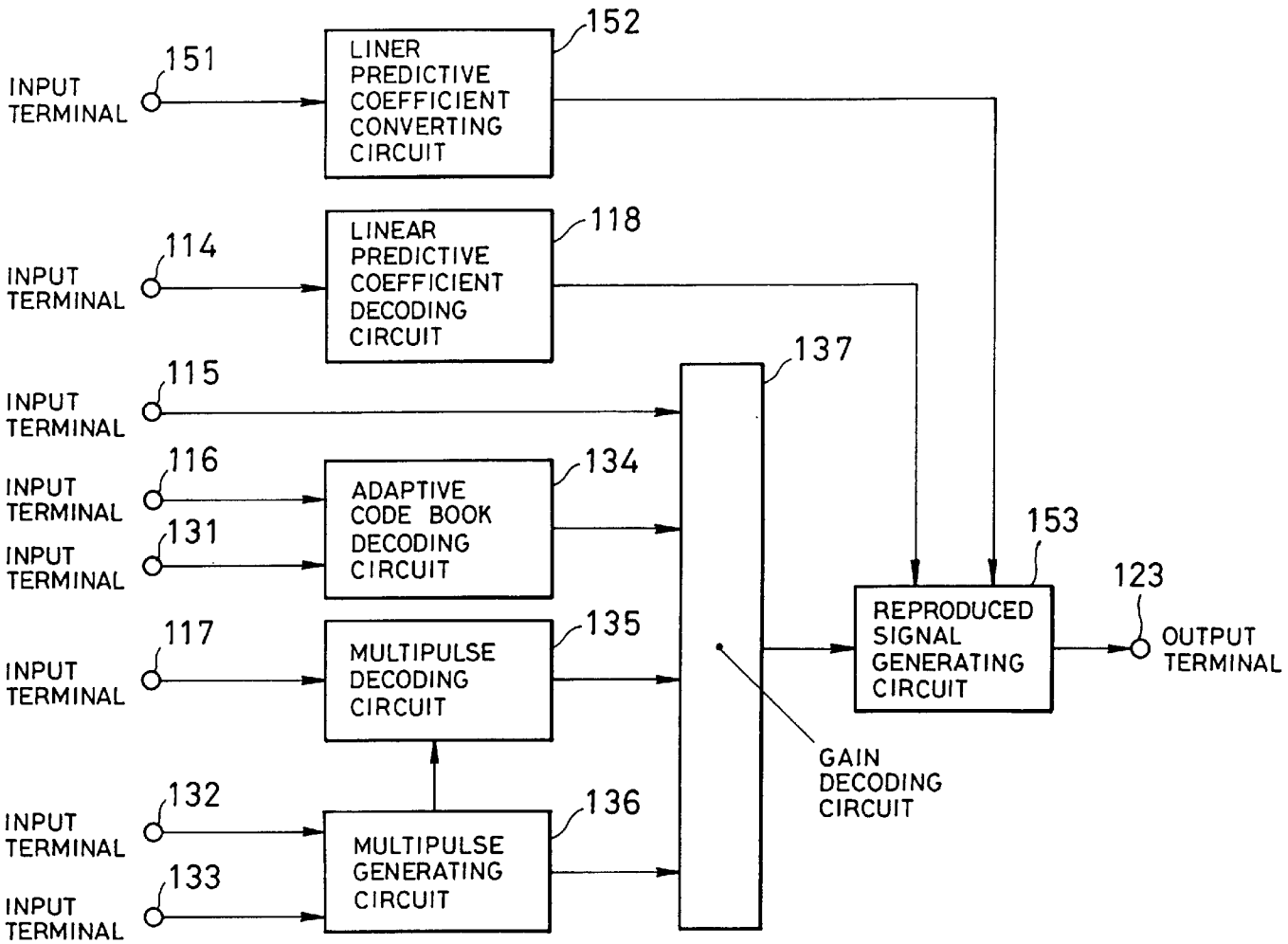
FIG. 8 is a block diagram showing a construction of a second CELP decoding circuit in the second embodiment of the voice coding and decoding system according to the invention.

Next, FIG. 8 is a block diagram showing a construction of the second CELP decoding circuit in the second embodiment of the voice coding and decoding system according to the present invention. Referring to FIG. 8, discussion will be given with respect to the second CELP decoding circuit 23 forming the voice decoding system in the second embodiment of the present invention.

The second CELP decoding circuit 23 is differentiated from the second CELP decoding circuit 17 in the foregoing first embodiment only in operations of the linear predictive coefficient converting circuit 152 and the reproduced signal generating circuit 153. The following disclosure will be concentrated to these circuits different from the former first embodiment.

Referring to FIG. 8, the linear predictive coefficient converting circuit 152 inputs the quantized linear predictive coefficient decoded by the first CELP decoding circuit 22 via the input terminal 151 to convert into the first quantized linear predictive coefficient in the similar manner as the linear predictive coefficient converting circuit 142 on the coding side, to output to the reproduced signal generating circuit 153. In the reproduced signal generating circuit 153, the reproduced signal is generated by driving the linear predictive synthesizing filter Hs'(z) by the excitation signal generated in the gain decoding circuit 137, to output to the output terminal 123.

In the foregoing second embodiment of the voice coding and decoding system according to the present invention, discussion has been given in terms of multi-stage coding of the pitch, multipulse and the linear predictive coefficient, similar is applicable for the case where one of two of the pitch, the multipulse and the linear predictive coefficient are coded by multi-stage coding.

Figure 9:
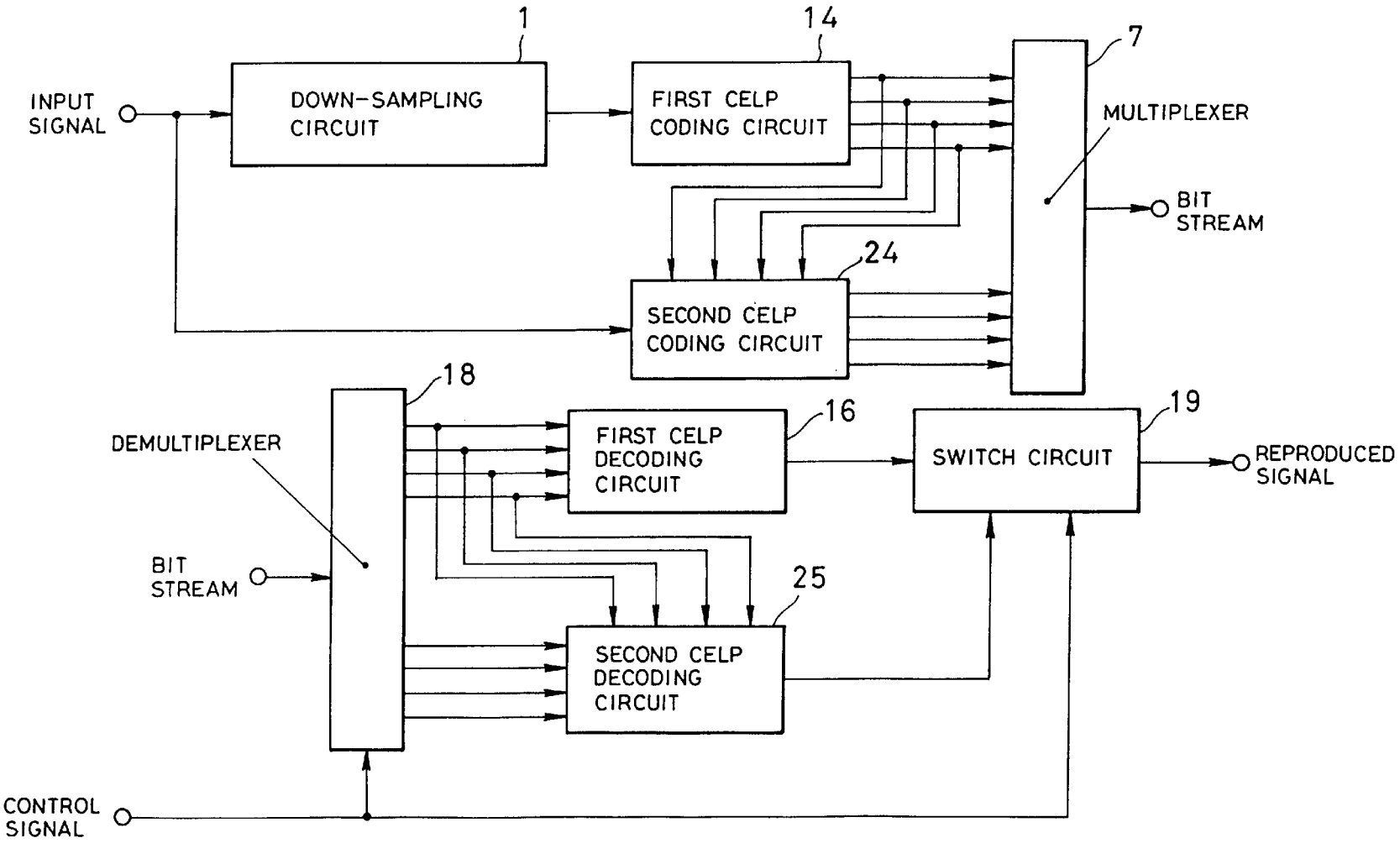
FIG. 9 is a block diagram showing a construction of the third embodiment of the voice coding and decoding system according to the present invention.

FIG. 9 is a block diagram showing a construction of the third embodiment of the voice coding and decoding system according to the present invention. Referring to FIG. 9. discussion will be given with respect to the third embodiment of the voice coding and decoding system according to the present invention. For simplification of disclosure, the discussion will be given for the case where number of hierarchies is two. Similar discussion will be given with respect to three or more hierarchies. In the shown embodiment, the bit stream coded by a voice coding system can be decoded by two kinds of bit rates (hereinafter referred to as high bit rate and low bit rate) in a voice decoding system.

The third embodiment of the voice coding and decoding system according to the present invention is differentiated from the first embodiment only in operations of the second CELP coding circuit 24 and the second CELP decoding circuit 25. Hereinafter, therefore, the following disclosure will be concentrated for these circuits different from those in the first embodiment in order to keep the disclosure simple enough by avoiding redundant discussion and whereby to facilitate clear understanding of the present invention.

The CELP coding circuit 24 codes the input signal on the basis of the four kinds of indexes ILd, ILj, ILk and LIa, and outputs the index Id of the adaptive code vector, the index Ij of the multipulse signal, the index Ik of the gain, and index Ia of the linear predictive coefficient, to the multiplexer 7.

Figure 10:
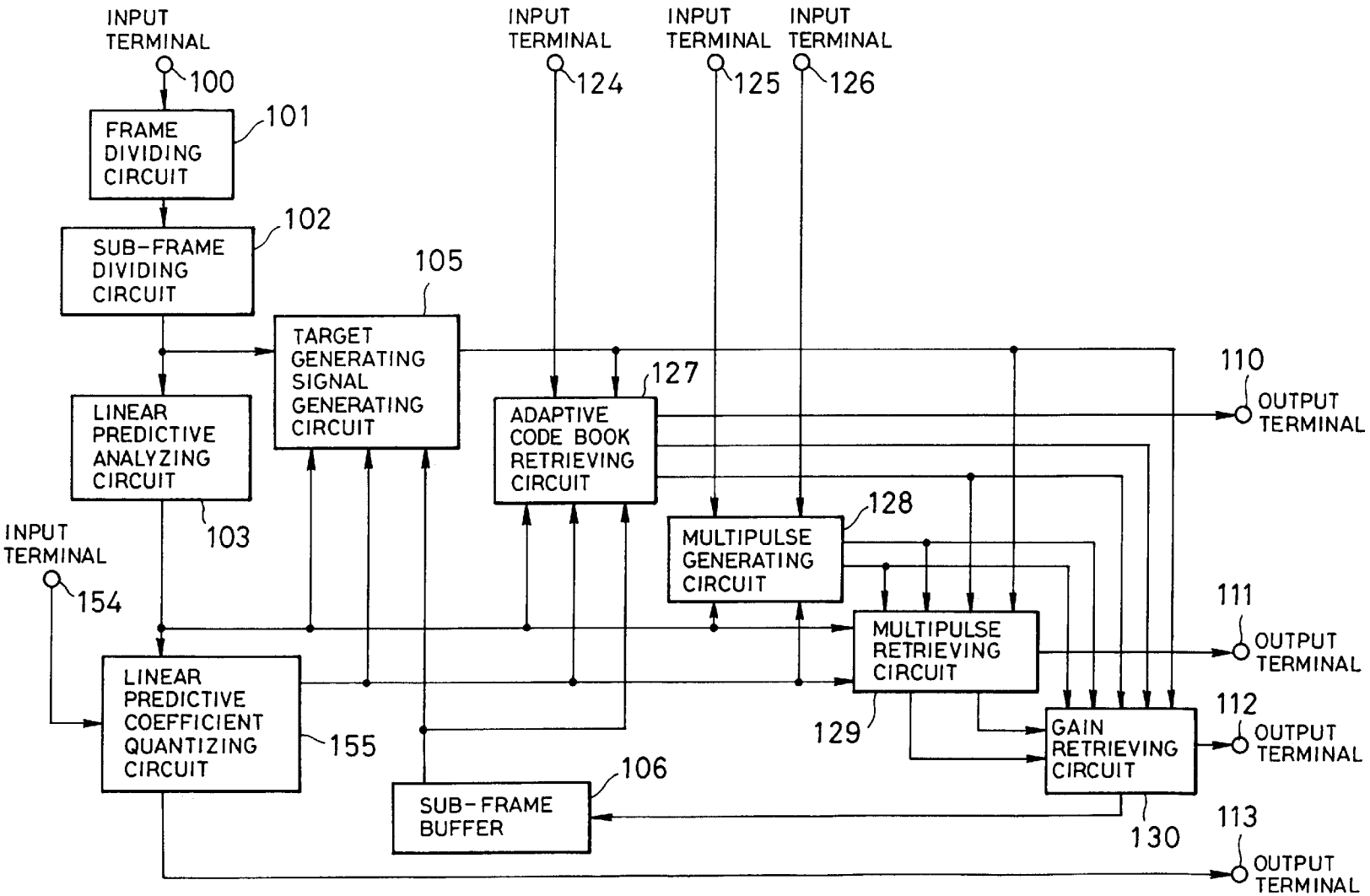
FIG. 10 is a block diagram showing a construction of a second CELP coding circuit in the third embodiment of the voice coding and decoding system according to the invention.

FIG. 10 is a block diagram showing a construction of the second embodiment of the CELP coding circuit 24. Referring to FIG. 10, discussion will be given with respect to the second CELP coding circuit 24. The second CELP coding circuit 24 is differentiated from the second CELP coding circuit 15 (see FIG. 2) in the first embodiment only in the operation of the linear predictive coefficient quantizing circuit 155. The following disclosure will be concentrated for the operation of the linear predictive coefficient quantizing circuit 155 and disclosure of the common part will be neglected.

Referring to FIG. 10, in the linear predictive coefficient quantizing circuit 155, a quantized LSP f(i), i=1. . . Np−1 (Np is the order to be subject linear predictive analysis, e.g. "10"). The decoded quantized LSP is converted by the first quantizing LSP f1(i), i=0, . . . Np−1 (Np' is the order of the linear predictive analysis in the second CELP coding circuit 24, e.g. "20") corresponding to the sampling frequency of the input signal of the second CELP coding circuit 24. Thereafter, a differential LSP of the LSP derived from the linear predictive coefficient obtained by the linear predictive analyzing circuit 103 and the first quantized LSP is quantized by a known LSP quantization method to derive a quantized differential LSP. It should be noted that the sampling frequency conversion of the quantized LSP can be realized by the following equation (16), for example.

$$f1(i)=0.5\times f(i)\quad i=0,\ldots,Np-1$$

$$f1(i)=0.0\quad i=Np,\ldots,Np'-1 \tag{16}$$

Also, the linear predictive coefficient quantizing circuit 155 derives a second quantized LSP by summing the quantized differential LSP and the first quantized LSP. After converting the second quantized LSP into the quantized linear predictive coefficient, the quantized linear predictive coefficient is output to the target signal generating circuit 105, the adaptive code book retrieving circuit 127 and the multipulse retrieving circuit 128 and an index indicative of the quantized linear predictive coefficient is output to the output terminal 113.

Next, discussion will be given with respect to the voice decoding system. The second CELP decoding circuit 25 decodes the second reproduced signal from the indexes ILd, LIj, ILk and ILa coded in the first CELP coding circuit 14 and the indexes Id, Ij, Ik and Ia coded in the second CELP coding circuit 24 to output to the switch circuit 19.

Figure 11:
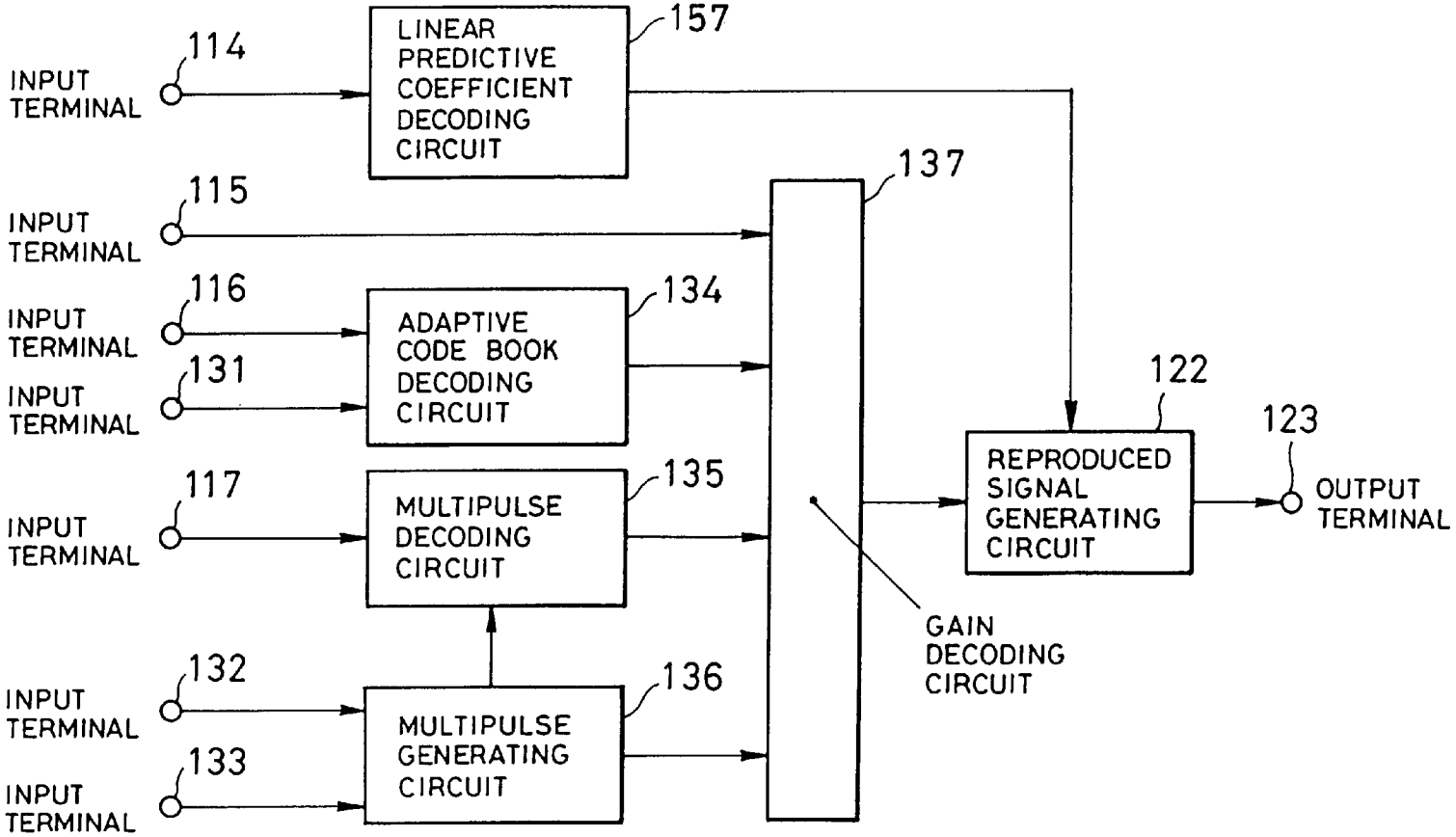
FIG. 11 is a block diagram showing a construction of a second CELP decoding circuit in the third embodiment of the voice coding and decoding system according to the invention.
Figure 12:
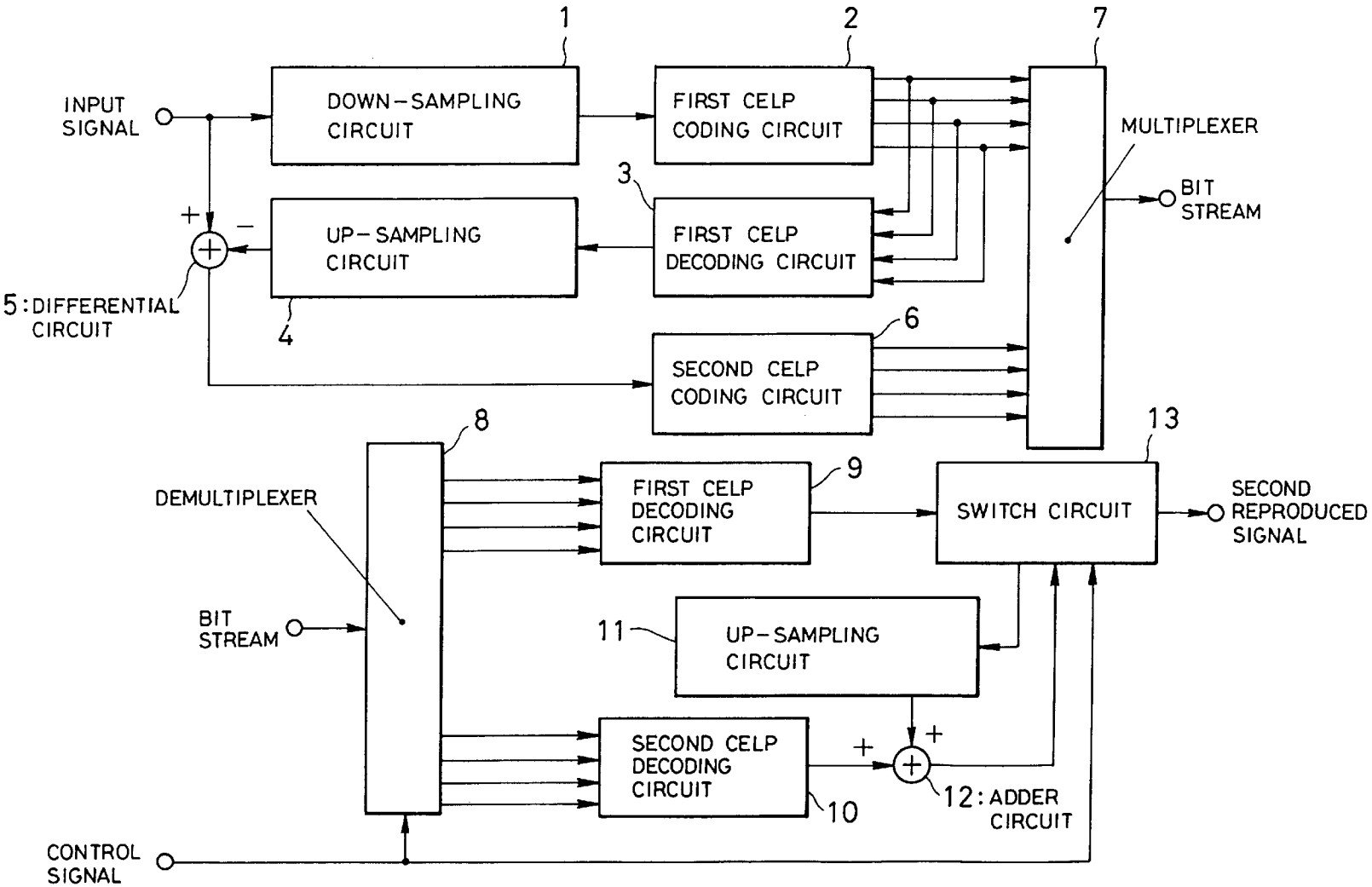
FIG. 12 is a block diagram showing a construction of the voice coding system, to which the present invention is directed.

FIG. 11 is a block diagram showing a construction of the CELP decoding circuit in the third embodiment of a voice coding and decoding system according to the present invention. Referring to FIG. 11, a difference between the second CELP decoding circuit 25 and the second CELP decoding circuit 17 (see FIG. 3) in the first embodiment of the present invention will be discussed hereinafter. In the third embodiment of the present invention, only operation of the linear predictive coefficient coding circuit 157 is differentiated from that in the foregoing first embodiment. Therefore, the following disclosure will be concentrated to the operation of the linear predictive coefficient decoding circuit 157.

In the linear predictive coefficient decoding circuit 157, the quantized LSP f(i), i=0, . . . , Np−1 is decoded from the index ILa input via the input terminal 114 to obtain the first quantized LSP f1(i), i=0, . . . , Np'−1. In conjunction therewith, the quantized differential LSP is decoded from the index Ia input via the input terminal 156 to derive the second quantized LSP by summing the first quantized LSP and the quantized differential LSP. After conversion of the second quantized LSP into the quantized linear predictive coefficient, the quantized linear predictive coefficient is output to the reproduced signal generating circuit 122.

It should be noted that while the shown embodiment has been disclosed in terms of the case of multi-stage coding of the pitch, the multipulse signal and the linear predictive coefficient, similar discussion will be applicable even for the case where one or two of the pitch, the multipulse signal and the linear predictive coefficient are multi-stage coded.

As set forth above, according to the present invention, coding efficiency in second and subsequent hierarchies in the hierarchical CELP coding can be improved.

The reason is that, in the present invention, instead of performing multi-stage coding on the signal, multi-stage coding is performed per each coding parameter.

Although the present irvention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal. obtained by lower sampling frequency, per every N hierarchies, comprising:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N).

2. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal in said decoding means of (n)th hierarchy (n=2, . . . , N).

3. A voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals; and a gain retrieving circuit coding gains of said adaptive code vector signal, said first multipulse signal, said second multipulse signal.

4. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal in said decoding means of (n)th hierarchy (n=2, . . . , N);

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal; and a gain decoding circuit decoding the gain from the index indicative of the gain of the (n)th hierarchy and generating an excitation signal from said adaptive code vector signal, said first multipulse signal, said second multipulse signal and the decoded gain.

5. A voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N) and having n-stage audibility weighted filters;

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals; and a gain retrieving circuit coding gains of said adaptive code vector signal, said first multipulse signal, said second multipulse signal;

a linear predictive coefficient converting circuit converting linear predictive coefficients coded and decoded up to the (n−1)th hierarchy into a coefficient on a sampling frequency of the input signal in the (n)th hierarchy;

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters.

6. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal;

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal;

a gain decoding circuit decoding the gain from the index indicative of the gain of the (n)th hierarchy and generating an excitation signal from said adaptive code vector signal, said first multipulse signal, said second multipulse signal and the decoded gain;

a linear predictive coefficient converting circuit converting linear predictive coefficients derived up to the (n−1)th hierarchy into a coefficient on the sampling frequency of the input signal in the (n)th hierarchy; and a reproduced signal generating circuit for generating a reproduced signal by driving n-stage linear predictive synthesizing filters by said excitation signal.

7. A voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

a linear predictive coefficient converting circuit converting linear predictive coefficients coded and decoded up to the (n−1)th hierarchy into a coefficient on a sampling frequency of the input signal in the (n)th hierarchy, in coding means of the (n)th hierarchy (n=2, . . . , N);

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters;

an adaptive code book retrieving circuit having n-stage audibility weighted reproduction filters;

a multipulse generating circuit;

to a multipulse retrieving circuit; and a target signal generating circuit having n-stage audibility weighted filters.

8. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream;

a linear predictive coefficient converting circuit converting linear predictive coefficients derived up to the (n−1)th hierarchy into a coefficient on a sampling frequency of the input signal in the (n)th hierarchy; and a reproduced signal generating circuit generating a reproduced signal by driving n-stage linear predictive synthesizing filters by said excitation signal.

9. A voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

a multipulse generating circuit generating a first multipulse signal from n−1 multipulse signals coded and decoded up to the (n−1)th hierarchy in the (n)th hierarchy (n=2, . . . , N) of coding means; and a multipulse retrieving circuit coding a pulse position of a second multipulse signal in the (n)th hierarchy among pulse position candidates excluding positions of pulses forming said first multipulse signal.

10. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n−1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream;

a multipulse generating circuit generating a first multipulse signal from the index indicative of up to the n−1 multipulse signals; and a multipulse decoding circuit decoding a second multipulse signal from the index indicative of the (n)th hierarchy of multipulse signal on the basis of pulse position candidates excluding the positions of the pulses forming said first multipulse signal.

11. A voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

coding means of each hierarchy including an adaptive code book retrieving circuit. generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals;

a gain retrieving circuit coding gains of said adaptive code vector signal, said first multipulse signal, said second multipulse signal; and a linear predictive quantizing circuit coding a difference between linear predictive coefficient coded and decoded up to (n−1)th hierarchy and linear predictive coefficient newly obtained by analysis at the (n)th hierarchy.

12. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch of (n)th hierarchy and generating an adaptive code vector signal;

a multipulse generating circuit generating a first multipulse signal from the index indicative of multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal;

a gain decoding circuit decoding the gain from the index indicative of the gain of the (n)th hierarchy and generating an excitation signal from said adaptive code vector signal, said first multipulse signal, said second multipulse signal and the decoded gain; and a linear predictive coefficient decoding circuit decoding a linear predictive coefficient from an index indicative of linear predictive coefficients up to the (n)th hierarchy.

13. A voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies, comprising:

a linear predictive quantization circuit for coding a difference between linear predictive coefficient coded and decoded up to (n−1)th hierarchy and a linear predictive coefficient newly obtained by analysis in coding of the (n)th hierarchy, in the (n)th hierarchy (n=2, . . . , N).

14. A voice decoding system hierarchically varying sampling frequencies of a reproduced signal depending upon bit rates to be decoded, comprising:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and a linear predictive coefficient decoding circuit decoding linear predictive coefficient from index indicative of linear predictive coefficient up to the (n)th hierarchy.

15. A voice coding and decoding system comprising:

a voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, said voice coding system including coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N); and a voice decoding system hierarchically varying sampling frequencies of a reproduced signal depending upon bit rates to be decoded, including decoding means, each corresponding to each of N kinds of decodable bit rates, demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice,coding system, and an adaptive code book decoding circuit decoding a pitch from an index indicative of the pitch up to (n)th hierarchy and generating an adaptive code vector signal in said decoding means of (n)th hierarchy (n=2, . . . , N).

16. A voice coding and decoding system comprising:

a voice coding system hierarchically coding a voice signal by generating a number of signals (N−1) with varying sampling frequencies of the input voice signal and multiplexing indexes indicative of a linear predictive coefficient, a pitch, a multipulse signal, and a gain obtained by sequentially coding from said input voice signal and the signals obtained by said varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 miltipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals; a gain retrieving circuit coding gains of said adaptive code vector signal, said first multipulse signal, said second multipulse signal; and a voice decoding system hierarchically varying sampling frequencies of a reproduced signal depending upon bit rates to be decoded, including decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multijpulse signal, gain and linear predictive coefficient of (n)th hierarchy, from said bit stream output by said voice coding system;

an adaptive code book decoding circuit decoding a pitch from an index indicative of the pitch up to (n)th hierarchy and generating an adaptive code vector signal in said decoding means of (n)th hierarchy (n=2, . . . , N);

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal; and a gain decoding circuit decoding the gain from the index indicative of the gain of the (n)th hierarchy and generating an excitation signal from said adaptive code vector signal, said first multipulse signal, said second multipulse signal and the decoded gain.

17. A voice coding and decoding system comprising:

a voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal for generating a bit stream and the signals obtained by said varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N) and having n-stage audibility weighted filters;

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals; and a gain retrieving circuit coding gains of said adaptive code vector signal, said first mulltipulse signal, said second multipulse signal;

a linear predictive coefficient converting circuit converting linear predictive coefficients coded and decoded up to the (n−1)th hierarchy into a coefficient on a sampling frequency of the input signal in the (n)th hierarchy;

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy among said decoding means depending upon a control signal indicative of a decoding bit rate and extracting an index indicative of pitches up to (n)th hierarchy and indexes of multipulse signal, gain and linear predictive coefficient of (n)th hierarchy, from a bit stream; and an adaptive code book decoding circuit decoding a pitch from an index indicative of the pitch up to (n)th hierarchy and generating an adaptive code vector signal in said decoding means of (n)th hierarchy (n=2, . . . , N);

a multipulse generating circuit generating a first multipulse signal from multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal;

a gain decoding circuit decoding the gain from the index indicative of the gain of the (n)th hierarchy and generating an excitation signal from said adaptive code vector signal, said first multipulse signal, said second multipulse signal and the decoded gain;

a linear predictive coefficient converting circuit converting linear predictive coef ficients derived up to the (n−1)th hierarchy into a coefficient on the sampling frequency of the input signal in the (n)th hierarchy; and a reproduced signal generating circuit for generating a reproduced signal by driving n-stage linear predictive synthesizing filter by said excitation signal.

18. A voice coding and decoding system comprising:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, including:

a linear predictive coefficient converting circuit converting linear predictive coef ficients coded and decoded up to the (n−1)th hierarchy into a coefficient on a sampling frequency of the input signal in the (n)th hierarchy, in coding means of the (n)th hierarchy (n=2, . . . , N);

a linear predictive residual difference signal generating circuit deriving a linear predictive residual difference signal of the input signal from the converted n−1 linear predictive coefficients;

a linear predictive analyzing circuit deriving a linear predictive coefficient by linear predictive analysis of derived linear predictive residual difference signal;

a linear predictive coefficient quantizing circuit quantizing newly derived linear predictive coefficient; and a target signal generating circuit having n-stage audibility weighted filters;

an adaptive code book retrieving circuit having n-stage audibility weighted reproduction filter;

a multipulse generating circuit;

a multipulse retrieving circuit; and a target signal generating circuit having n-stage audibility weighted filters; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice coding system;

a linear predictive coefficient converting circuit converting linear predictive coefficients derived up to the (n−1)th hierarchy into a coefficient on a sampling frequency of the input signal in the (n)th hierarchy; and a reproduced signal generating circuit generating a reproduced signal by driving n-stage linear predictive synthesizing filters by said excitation signal.

19. A voice coding and decoding system comprising:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, including:

a multipulse generating circuit generating a first multipulse signal from n−1 multipulse signal coded and decoded up to the (n−1)th hierarchy in the (n)th hierarchy (n=2, . . . , N) of coding means; and a multipulse retrieving circuit coding a pulse position of a second multipul.se signal in the (n)th hierarchy among pulse position candidates excluding positions of pulses forming said first multipulse signal; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n−1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice coding system;

a multipulse generating circuit generating a first multipulse signal from the index indicative of up to the n−1 multipulse signals; and a multipulse decoding circuit decoding a second multipulse signal from the index indicative of the (n)th hierarchy of multipulse signal on the basis of pulse position candidates excluding the positions of the pulses forming said first multipulse signal.

20. A voice coding and decoding system comprising:

a voice coding system hierarchically coding a voice signal by generating a number of signals (N−1) with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, including:

coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N);

a multipulse generating circuit generating a first multipulse signal from n−1 multipulse signals coded and decoded up to (n−1)th hierarchy;

a multipulse retrieving circuit coding a pulse position of the second multipulse signal in (n)th hierarchy among pulse position candidates excluding positions of pulses forming said first multipulse signals;

a gain retrieving circuit coding gains of said adaptive code vector signal, said first multipulse signal, said second multipulse signal; and a linear predictive quantizing circuit coding a difference between linear predictive coefficient coded and decoded up to (n−1)th hierarchy and linear predictive coefficient newly obtained by analysis at the (n)th hierarchy; and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice coding system; and an adaptive code book decoding circuit decoding a pitch from an index indicative of the pitch of (n)th hierarchy and generating an adaptive code vector signal;

a multipulse generating circuit generating a first multipulse signal from the index indicant of multipulse signals up to (n−1)th hierarchies and gains;

a multipulse decoding circuit decoding a second multipulse signal from an index indicative of the multipulse signal of the (n)th hierarchy on the basis of pulse position candidates excluding positions of pulses forming said first multipulse signal;

a gain decoding circuit decoding the gain from the index indicative of the gain of the (n)th hierarchy and generating an excitation signal from said adaptive code vector signal, said first multipulse signal, said second multipulse signal and the decoded gain; and a linear predictive coefficient decoding circuit decoding a linear predictive coefficient from an index indicative of linear predictive coefficients up to the (n)th hierarchy.

21. A voice coding and decoding system comprising:

a voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, including:

a linear predictive quantization circuit for coding a difference between linear predictive coefficient coded and decoded up to (n−1)th hierarchy and a linear predictive coefficient newly obtained by analysis in coding of the (n)th hierarchy, in the (n)th hierarchy (n=2, . . . , N); and a voice decoding system hierarchically varying sampling frequencies of a reproduced signal depending upon bit rates to be decoded, including:

decoding means, each corresponding to each of N kinds of decodable bit rates;

demultiplexer selecting of decoding means of (n)th hierarchy (n=1, . . . , N) among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice coding system; and a linear predictive coefficient decoding circuit decoding linear predictive coefficient from index indicative of linear predictive coefficient up to the (n)th hierarchy.

22. A voice coding and decoding system comprising:

a down-sampling circuit down-sampling an input signal for outputting as a first input signal;

first coding means for coding said first input signal;

second coding means for coding said input signal on the basis of a coding output of said first coding means;

a multiplexer outputting the coded outputs of said first coding means and said second coding means in a form of a bit stream;

a demultiplexer inputting said bit stream and a control signal, when said control signal is indicative of a first bit rate, said coding output of said first coding means being output from said bit stream to a first decoding means, and when said control signal is indicative of a second bit rate, a part of the coded output of said first coding means and the coded output of said second coding means being extracted from said bit stream for outputting to a second decoding means, said first and second decoding means decoding a reproduced signal depending on said control signal for outputting via a switch.

23. A voice coding and decoding system as set forth in claim 22, wherein said second coding means comprises coding means of the second hierarchy in said voice coding system hierarchically coding a voice signal by generating N−1 signals with varying sampling frequencies of the input voice signal and multiplexing indexes indicative of a linear predictive coefficient, a pitch, a multipulse signal and a gain obtained by sequentially coding from said input voice signal and the signals obtained by said varying sampling frequencies in sequential order to the signal obtained by lower sampling frequency, per every N hierarchies for generating a bit stream, said voice coding system including coding means of each hierarchy including an adaptive code book retrieving circuit generating a corresponding adaptive code book signal by coding a differential pitch with respect to pitches coded and decoded up to (n−1)th hierarchy in (n)th hierarchy (n=2, . . . , N).

24. A voice coding and decoding system as set forth in claim 22, wherein said second decoding means comprises decoding means of the second hierarchy (n=2) of a voice decoding system hierarchically varying sampling frequencies of a reproduced signal depending upon bit rates to be decoded, including decoding means, each corresponding to each of N kinds of decodable bit rates, demultiplexer selecting of decoding means of (n)th hierarchy (n=1, . . . , N)

among said decoding means depending upon a control signal indicative of a decoding bit rate and extracting an index indicative of pitches up to (n)th hierarchy and indexes of multipulse signal, gain and linear predictive coefficient of (n)th hierarchy, from said bit stream generated by said voice coding system, and an adaptive code book decoding circuit decoding a pitch from an index indicative of the pitch up to (n)th hierarchy and generating an adaptive code vector signal in said decoding means of (n)th hierarchy (n=2, . . . , N).

* * * * *